US012365847B2

(12) United States Patent
Lin et al.

(10) Patent No.: US 12,365,847 B2
(45) Date of Patent: Jul. 22, 2025

(54) LUBRICITY IMPROVER COMPOSITION FOR FUEL OIL AND USE THEREOF

(71) Applicants: CHINA PETROLEUM & CHEMICAL CORPORATION, Beijing (CN); SINOPEC RESEARCH INSTITUTE OF PETROLEUM PROCESSING CO., LTD., Beijing (CN)

(72) Inventors: Jianmin Lin, Beijing (CN); Xin Xia, Beijing (CN); Baoshi Li, Beijing (CN); Zhiping Tao, Beijing (CN); Yan Li, Beijing (CN)

(73) Assignees: CHINA PETROLEUM & CHEMICAL CORPORATION, Beijing (CN); SINOPEC RESEARCH INSTITUTE OF PETROLEUM PROCESSING CO., LTD., Beijing (CN)

( * ) Notice: Subject to any disclaimer, the term of this patent is extended or adjusted under 35 U.S.C. 154(b) by 0 days.

(21) Appl. No.: 18/575,787

(22) PCT Filed: Jun. 30, 2022

(86) PCT No.: PCT/CN2022/102570
§ 371 (c)(1),
(2) Date: Dec. 29, 2023

(87) PCT Pub. No.: WO2023/274335
PCT Pub. Date: Jan. 5, 2023

(65) Prior Publication Data

US 2024/0368490 A1 Nov. 7, 2024

(30) Foreign Application Priority Data

Jun. 30, 2021 (CN) ..... 202110740397.8

(51) Int. Cl.
*C10L 1/19* (2006.01)
*C10L 1/188* (2006.01)

(52) U.S. Cl.
CPC ..... *C10L 1/1905* (2013.01); *C10L 1/1881* (2013.01); *C10L 2200/0446* (2013.01)

(58) Field of Classification Search
CPC ..... C10L 1/1905; C10L 1/1881; C10L 2200/0446; C10L 1/026; C10L 10/08; C10L 2270/026; C10L 1/14; C10L 1/19
See application file for complete search history.

(56) References Cited

U.S. PATENT DOCUMENTS 4,248,182 A * 2/1981 Malec ..... C10L 1/18 44/326
6,051,039 A * 4/2000 Sugimoto ..... C10L 1/224 44/341

FOREIGN PATENT DOCUMENTS

CN 86103481 A 2/1987
CN 1149312 A 5/1997
(Continued)

OTHER PUBLICATIONS

Anastopoulos, G. et al.; "Influence of aceto acetic esters and di-carboxylic acid esters on diesel fuel lubricity"; Tribology International; vol. 34, No. 11; Year: 2001; pp. 749-755.

*Primary Examiner* — Cephia D Toomer
(74) *Attorney, Agent, or Firm* — NKL Law; Allen Xue

(57) ABSTRACT

A lubricity improver composition for fuel oil composition contains a dicarboxylic acid monoester represented by the formula (I) as component A, and a $C_{8-24}$ long-chain fatty acid, its polyol ester or a mixture thereof as component B. The total amount of component A and component B is 70-100 wt %, based on the total weight of the composition. The mass ratio of component A to component B is 9:1 to 1:9.

21 Claims, 4 Drawing Sheets

(56) References Cited

FOREIGN PATENT DOCUMENTS

| | | | |
|---|---|---|---|
| CN | 1349556 | A | 5/2002 |
| CN | 100999685 | A | 7/2007 |
| CN | 101213276 | A | 7/2008 |
| CN | 106318568 | A | 1/2017 |
| CN | 106929112 | A | 7/2017 |
| CN | 109576021 | A | 4/2019 |
| CN | 112779065 | A | 5/2021 |
| EP | 773279 | A1 | 5/1997 |
| EP | 798364 | A1 | 10/1997 |
| EP | 1209217 | A2 | 5/2002 |
| WO | 9417160 | A1 | 8/1994 |
| WO | 9915607 | A1 | 4/1999 |

* cited by examiner

LUBRICITY IMPROVER COMPOSITION FOR FUEL OIL AND USE THEREOF

CROSS REFERENCE TO RELATED APPLICATIONS

This application is a U.S. national stage entry of PCT International Application No. PCT/CN2022/102570, filed on Jun. 30, 2022, which claims the priority of Chinese patent application No. 202110740397.8, titled "lubricity additive composition for diesel fuel, its preparation and diesel fuel composition", filed on Jun. 30, 2021, the contents of which is incorporated herein by reference in their entirety.

TECHNICAL FIELD

The present application relates to the field of fuel oil, particularly to a lubricity improver composition for fuel oil and use thereof.

BACKGROUND ART

With the increasing concern of countries around the world on environmental problems, the production of high-quality clean energy has become the development direction of the modern oil refining industry, and the production standard of diesel fuel is gradually improved. The clean diesel fuel has the characteristics of low aromatic hydrocarbon content, high cetane number, lighter in fraction, low sulfur and low nitrogen. Sulfur is the most harmful element that increases the level of pollutants in the atmosphere, and the level of sulfur-containing compounds in diesel fuel is therefore tightly controlled. The clean diesel fuel produced at present is mainly produced by adopting a hydrogenation process, and the method removes sulfur-containing compounds in the diesel fuel and simultaneously reduces the content of nitrogen-containing compounds and oxygen-containing compounds in the diesel fuel. The lubricity of diesel fuel is known to depend primarily on the level of lubricity improving impurities in the diesel fuel, polycyclic aromatics, oxygen-containing impurities and nitrogen-containing impurities being very effective lubricity improving agents. The lower content of nitrogen compounds and oxygen compounds causes a decrease in the lubricating performance of the diesel fuel itself, resulting in wear and failure of the fuel pump.

Because low-sulfur diesel fuels have poor lubricity, low-sulfur diesel fuels and ultra-low-sulfur diesel fuels are often treated with lubricity improvers (also known as lubricity additives or anti-wear additives) to improve their lubricity. The method has the advantages of low cost, flexible production, less pollution and the like, and is widely regarded in industry.

Diesel lubricity improvers are mostly derivatives of fatty acids, fatty acid esters, amides or salts. EP773279 discloses carboxylic acid esters prepared by reacting dimer acid with alcohol amine as diesel lubricity improvers. EP798364 discloses salts or amides prepared by reacting fatty acids with fatty amines as diesel lubricity improvers. EP1209217 discloses reaction products of $C_{6-50}$ saturated fatty acids and dicarboxylic acids with short chain oil soluble primary, secondary and tertiary amines as diesel lubricity improvers. WO9915607 discloses the reaction product of a dimer fatty acid with an epoxide as a diesel lubricity improver. Most of those technologies involve the reaction of fatty acid or fatty acid dimer with alcohol amine, amine and epoxide, wherein some reaction starting materials are expensive and show a general lubricity improving effect, and the addition amount in diesel fuel is larger.

Existing industrial low-sulfur diesel lubricity improvers mainly comprise two types, namely acid type lubricity improvers and ester type lubricity improvers, wherein the main component of the acid type lubricity improver is long-chain unsaturated fatty acid such as oleic acid, linoleic acid, linolenic acid and the like, and a typical product is refined tall oil fatty acid. The ester-type lubricity improver is an esterification reaction product of the above fatty acid and a polyhydric alcohol. WO9417160A1 discloses the use of oleic acid monoglyceride as a diesel lubricity improver.

Although the use of a fatty acid type lubricity improver for solving the lubricity problem of diesel fuel is relatively low in cost, the problems of excessive diesel fuel acidity, increase in risk of corrosion, and the like may be caused by the large amount to be used, due to the upgrading of the emission standard for diesel fuel and the deterioration of the lubricity thereof. Although the fatty acid ester type lubricity improver may be used in a small amount, there are also problems of high cost, and a risk of emulsifying and clouding of diesel fuel modified with the improver when being mixed with water.

CN109576021A discloses a lubricity improver for low-sulfur diesel and preparation thereof, wherein unsaturated dicarboxylic acid ester (maleic diester) and a polymerization inhibitor are mixed at 150-180° C., tung oil biodiesel is gradually added, the reaction is continued for a certain time at a temperature of 200-240° C., and an improver product is obtained by distillation under reduced pressure after the reaction. The product needs tung oil biodiesel, which starting material is rare and unstable, the reaction needs high temperature, the preparation is difficult to be performed, and the most important is that the lubricity improving effect is very general and more than 600 ppm of the improver is needed.

CN106929112A discloses a method for improving the lubricity of low-sulfur diesel, which improves the lubricity of diesel fuel by using an esterification reaction product of alkenyl succinic anhydride and monohydric aliphatic alcohol, but the product has high viscosity and has a general effect of improving the lubricity of ultra-low-sulfur diesel (such as vehicle diesel reaching the National VI emission standard).

An article published in the journal of Tribology International (G. Anatopoulos, E. Lois. inflammation of acetic acids esters and di-carboxylic acids esters on dicarboxylic acid ester lube lubricity [J]. Tribology International, 2001, 34 (11): 749-755) reports the improvement of lubricity by the addition of dicarboxylic acid diesters such as dibutyl adipate, dioctyl adipate, diethyl azelate, dibutyl azelate, dioctyl azelate, diethyl sebacate to low-sulfur diesel fuel, but the diester compounds show poor lubricity improving effect and need to be added at a amount of 500 ppm or even above 1000 ppm.

SUMMARY OF THE INVENTION

It is an object of the present application to provide a lubricity improver composition for fuel oil and use thereof, which can overcome the disadvantages of the prior art and provide satisfactory lubricity improvement at a lower dosage.

In order to achieve the above object, in an aspect, the present application provides a lubricity improver composition for fuel oil, comprising:

Component A: a dicarboxylic acid monoester represented by the following formula (I),

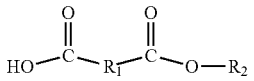

(I)

wherein $R_1$ is a $C_{1-10}$ divalent hydrocarbyl group;

$R_2$ is a $C_{1-20}$ hydrocarbyl group, or a moiety having the structure of —$R_3$—C(=O)—O—$R_4$;

$R_3$ is a $C_{8-24}$ divalent hydrocarbyl group;

$R_4$ is hydrogen or a $C_{1-10}$ hydrocarbyl group; and

Component B: a $C_{8-24}$ long-chain fatty acid, its polyol ester or a mixture thereof, wherein the total amount of component A and component B is 70-100 wt % of the total weight of the composition; and the mass ratio of the component A to the component B is 9:1 to 1:9.

After intensive research and a great deal of experiments, the inventors of the present application unexpectedly found that when a dicarboxylic acid monoester represented by the formula (I) and a $C_{8-24}$ long-chain fatty acid or its polyol ester are formulated into a composition at a specific ratio, the lubricity of a low-sulfur diesel fuel can be greatly improved by adding thereto only a small amount of the composition, and that the composition shows an unexpected synergistic effect, which is significantly superior to that of currently commercially used fatty acid type or fatty acid glyceride type lubricity improvers, thereby greatly reducing the amount of the lubricity improver.

In another aspect, the present application provides a method for improving the lubricity of diesel fuel, comprising adding to a low-sulfur diesel fuel a lubricity improver composition for fuel oil according to the present application, wherein the lubricity improver composition for fuel oil is preferably added in an amount of from 10 to 400 ppm, based on the mass of the low-sulfur diesel fuel.

In a further aspect, the present application provides a diesel fuel composition comprising a low-sulfur diesel fuel and a lubricity improver composition for fuel oil according to the present application, wherein the lubricity improver composition for fuel oil is preferably present in the diesel fuel composition in an amount of from 10 to 400 ppm, based on the mass of the low-sulfur diesel fuel.

The fuel oil lubricity improver disclosed in the present application is simple and convenient to be produced from easily obtainable starting materials, and unexpectedly superior in effect to conventional fatty acid type or fatty acid ester type lubricity improvers, and can remarkably improve the lubricity of low-sulfur diesel fuel, so that the addition amount can be greatly reduced, and the use cost can be greatly reduced.

In addition, the lubricity improver composition for fuel oil according to the present application also has an effect of improving lubricity in gasoline and jet fuel.

Other characteristics and advantages of the present application will be described in detail in the detailed description hereinbelow.

BRIEF DESCRIPTION OF THE DRAWINGS

The drawings, forming a part of the present description, are provided to help the understanding of the present application, and should not be considered to be limiting. The present application can be interpreted with reference to the drawings in combination with the detailed description hereinbelow. In the drawings.

DETAILED DESCRIPTION OF THE INVENTION

Figure 1:
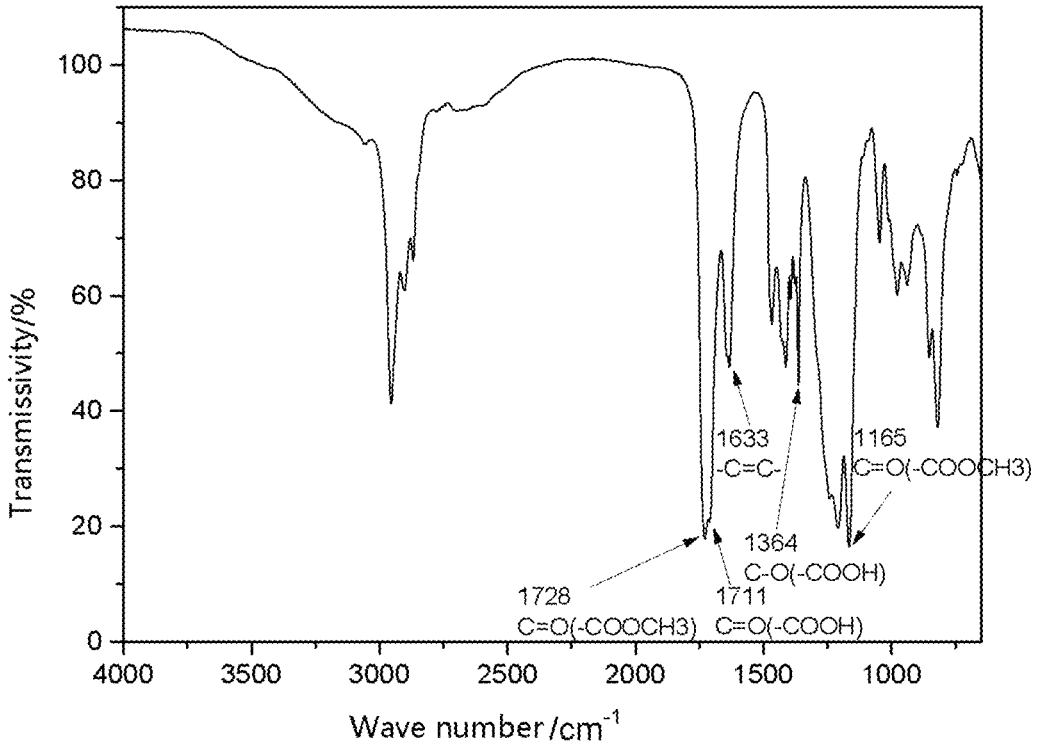
FIG. 1 shows an infrared spectrum of the product obtained in Preparation Example 1.

The present application will be further described hereinafter in detail with reference to the drawing and specific embodiments thereof. It should be noted that the specific embodiments of the present application are provided for illustration purpose only, and are not intended to be limiting in any manner.

Any specific numerical value, including the endpoints of a numerical range, described in the context of the present application is not restricted to the exact value thereof, but should be interpreted to further encompass all values close to said exact value, for example all values within ±5% of said exact value. Moreover, regarding any numerical range described herein, arbitrary combinations can be made between the endpoints of the range, between each endpoint and any specific value within the range, or between any two specific values within the range, to provide one or more new numerical range(s), where said new numerical range(s) should also be deemed to have been specifically described in the present application.

Unless otherwise stated, the terms used herein have the same meaning as commonly understood by those skilled in the art; and if the terms are defined herein and their definitions are different from the ordinary understanding in the art, the definition provided herein shall prevail.

In the present application, the term "hydrocarbyl group" generally refers to various groups formed by removing one hydrogen atom from saturated or unsaturated organic compounds consisted of carbon atoms and hydrogen atoms, such as various aliphatic, alicyclic and aromatic compounds. Specific examples of the hydrocarbyl group include, but are not limited to, linear or branched alkyl groups (also referred to as "alkyl"), linear or branched alkenyl groups (also referred to as "alkenyl"), linear or branched alkynyl groups, cycloalkyl groups, alkylcycloalkyl groups, cycloalkylalkyl groups, alkenylcycloalkyl groups, cycloalkylalkenyl groups, cycloalkenyl groups, alkylcycloalkenyl groups, cycloalkenylalkyl groups, aryl groups, arylalkyl groups, alkylaryl groups, and the like.

In the present application, the term "divalent hydrocarbyl group (also referred to as "alkylene group")" generally refers to various groups formed by removing two hydrogen atoms from saturated or unsaturated organic compounds consisted of carbon atoms and hydrogen atoms, such as various aliphatic, alicyclic, and aromatic compounds. Specific examples of the divalent hydrocarbyl group include, but are not limited to, linear or branched alkylene groups (also referred to as "divalent alkyl"), linear or branched alkenylene groups (also referred to as "divalent alkenyl"), linear or branched alkynylene groups, cycloalkylene groups, -alkyl-cycloalkyl-, -cycloalkyl-alkyl-, -alkenyl-cycloalkyl-, -cycloalkyl-alkenyl-, cycloalkenylene, -alkyl-cycloalkenyl-, -cycloalkenyl-alkyl-, arylene groups (also referred to as "divalent aryl"), -aryl-alkyl-, -alkyl-aryl-, and the like.

In the present application, unless otherwise indicated, the "hydrocarbyl group" and the "divalent hydrocarbyl group" may be substituted or unsubstituted, preferably unsubstituted.

In the present application, the term "alkenyl" refers to an aliphatic hydrocarbyl group having at least one (e.g., 1 to 5, preferably 1 to 3) carbon-carbon double bond, which may be in the main chain or in the side chain of the alkenyl group, and no carbon-carbon triple bond in the carbon chain, such as vinyl, propenyl, allyl, and the like.

In the present application, the term "alkenylene" refers to an aliphatic hydrocarbylene group having at least one (e.g., 1 to 5, preferably 1 to 3) carbon-carbon double bond, which may be in the main chain or in the side chain of the alkenylene group, and no carbon-carbon triple bond in the carbon chain, such as vinylene, —($CH_2$=)C—$CH_2$—, —($CH_3$)C=CH—, —($CH_3$)C=C($CH_3$)—, and the like.

In the present application, the expressions "optionally substituted" and "substituted or unsubstituted" may be used interchangeably to indicate that the group modified by such expression may be an unsubstituted group or a group substituted with one or more substituents.

In the present application, unless otherwise indicated, the term "substituted" means that the group modified by such an expression is substituted by one or more (e.g. 1, 2 or 3) groups selected from $C_{1-10}$ linear or branched hydrocarbyl groups, halogen, hydroxyl, carboxyl, ester, ether, nitro and amino groups, preferably from $C_{1-4}$ linear or branched hydrocarbyl groups, such as methyl, ethyl, n-propyl, isopropyl, n-butyl, isobutyl, vinyl, propenyl, and allyl groups and the like.

In the context of the present application, in addition to those matters explicitly stated, any matter or matters not mentioned are considered to be the same as those known in the art without any change. Moreover, any of the embodiments described herein can be freely combined with another one or more embodiments described herein, and the technical solutions or ideas thus obtained are considered as part of the original disclosure or original description of the present application, and should not be considered to be a new matter that has not been disclosed or anticipated herein, unless it is clear to the person skilled in the art that such a combination is obviously unreasonable.

All of the patent and non-patent documents cited herein, including but not limited to textbooks and journal articles, are hereby incorporated by reference in their entirety.

In a first aspect, the present application provides a lubricity improver composition for fuel oil, comprising:

Component A: a dicarboxylic acid monoester represented by the following formula (I),

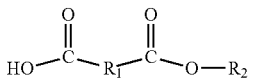

(I)

wherein $R_1$ is a $C_{1-10}$ divalent hydrocarbyl group;

$R_2$ is a $C_{1-20}$ hydrocarbyl group, or a moiety having the structure of —$R_3$—C(=O)—O—$R_4$;

$R_3$ is a $C_{8-24}$ divalent hydrocarbyl group;

$R_4$ is hydrogen or a $C_{1-10}$ hydrocarbyl group; and

Component B: a $C_{8-24}$ long-chain fatty acid, its polyol ester or a mixture thereof, wherein the total amount of component A and component B is 70-100 wt % of the total weight of the composition; and the mass ratio of the component A to the component B is 9:1 to 1:9.

Depending on the circumstances, small amounts of additional components, such as diesel fuel, organic solvents, unreacted starting materials (such as alcohols or phenols), reaction by-products (such as dicarboxylic acid diester compounds), and the like, may be present in the lubricity improver composition for fuel oil of the present application in addition to the component A and component B, but the total amount of those additional components is no more than 20 wt %, preferably no more than 10 wt %, more preferably no more than 5 wt %, for example no more than 1 wt %, of the total weight of the lubricity improver composition for fuel oil.

In a preferred embodiment, the total amount of component A and component B is 80 to 100 wt %, more preferably 90 to 100 wt %, such as 91 wt %, 92 wt %, 93 wt %, 94 wt %, 95 wt %, 96 wt %, 97 wt %, 98 wt %, 99 wt %, or 100 wt %, of the total weight of the lubricity improver composition for fuel oil.

In some preferred embodiments, in the lubricity improver composition for fuel oil, the component B is a $C_{8-24}$ long-chain fatty acid, and the mass ratio of component A to component B is from 8:2 to 2:8, preferably from 7:3 to 3:7, more preferably from 7:3 to 5:5, for example from 7:3 to 6:4.

In some preferred embodiments, in the lubricity improver composition for fuel oil, the component B is a polyol ester of a $C_{8-24}$ long-chain fatty acid, and the mass ratio of component A to component B is from 8:2 to 1:9, preferably from 8:2 to 2:8, more preferably from 5:5 to 2:8, for example from 4:6 to 3:7.

In some particularly preferred embodiments, the fuel lubricity improver consists essentially of component A and component B, that is contains only component A and component B, except for unavoidable impurities (such as unreacted starting materials, and reaction by-products), the component B is a $C_{8-24}$ long-chain fatty acid, and the composition comprises 20 to 80 wt %, preferably 30 to 70 wt %, more preferably 50 to 70 wt %, such as 60 to 70 wt %, of the component A, and 20 to 80 wt %, preferably 30 to 70 wt %, more preferably 30 to 50 wt %, such as 30 to 40 wt %, of the component B, based on the weight of the composition.

In some particularly preferred embodiments, the fuel lubricity improver consists essentially of component A and component B, that is contains only component A and component B, except for unavoidable impurities (such as unreacted starting materials, and reaction by-products), the component B is a polyol ester of a $C_{8-24}$ long-chain fatty acid, and the composition comprises 10 to 80 wt %, preferably 20 to 80 wt %, more preferably 20 to 50 wt %, such as 30 to 40 wt %, of component A, and 20 to 90 wt %, preferably 20 to 80 wt %, more preferably 50 to 80 wt %, such as 60 to 70 wt %, of component B, based on the weight of the composition.

The lubricity improver of the present application may be used alone to improve the lubricity of fuel oils, such as diesel fuel, or may be used in combination with one or more other fuel additives, such as phenolic antioxidants, polymeric amine-type ashless dispersants, flow improvers, cetane number improvers, metal deactivators, antistatic agents, corrosion inhibitors, rust inhibitors, demulsifiers, and the like, to improve the lubricity and one or more other properties of the fuel oil, as desired.

Component A and component B of the composition of the present application will be described in further detail below.

Component A

According to the present application, the component A is a dicarboxylic acid monoester represented by the following formula (I), (I)

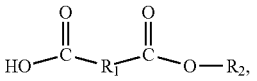

wherein $R_1$ is a $C_{1-10}$ divalent hydrocarbyl group;

$R_2$ is a $C_{1-20}$ hydrocarbyl group, or a moiety having the structure of —$R_3$—C(=O)—O—$R_4$;

$R_3$ is a $C_{8-24}$ divalent hydrocarbyl group;

$R_4$ is hydrogen or a $C_{1-10}$ hydrocarbyl group.

In some preferred embodiments, in the structural formula (I):

$R_1$ is a $C_{1-10}$ divalent alkyl group, a $C_{2-10}$ divalent alkenyl group or a moiety having the structure of —$R_5$-$R_6$-$R_7$—, preferably a $C_{1-8}$ divalent alkyl group, a $C_{2-6}$ divalent alkenyl group or a moiety having the structure of —$R_5$-$R_6$-$R_7$—, more preferably a $C_{1-4}$ divalent alkyl group or a $C_{2-4}$ divalent alkenyl group;

$R_2$ is a $C_{3-20}$ hydrocarbyl group, preferably a $C_{3-20}$ linear or branched hydrocarbyl group, a $C_{4-20}$ alicyclic hydrocarbyl group, a $C_{7-20}$ aryl-substituted hydrocarbyl group or a $C_{7-20}$ hydrocarbyl-substituted aryl group, more preferably a $C_{3-18}$ linear or branched hydrocarbyl group, a $C_{4-18}$ alicyclic hydrocarbyl group, a $C_{7-18}$ aryl-substituted hydrocarbyl group or a $C_{7-18}$ hydrocarbyl-substituted aryl group;

$R_5$ and $R_7$ are each independently a single bond, or a $C_{1-3}$ divalent hydrocarbyl group, preferably each independently a single bond or methylene;

$R_6$ is a $C_{3-10}$ divalent alicyclic hydrocarbyl group, or a $C_{6-10}$ substituted or unsubstituted divalent aryl group, preferably a $C_{4-7}$ divalent alicyclic hydrocarbyl group, or a $C_{6-10}$ substituted or unsubstituted divalent aryl group, and the total number of carbon atoms of the $R_5$, $R_6$ and $R_7$ groups is 10 or less;

wherein said "substituted" means substituted with one or more groups selected from $C_{1-4}$ linear or branched hydrocarbyl groups, halogen, hydroxyl group, carboxyl group, ester group, ether group, nitro group, and amino group, preferably from $C_{1-4}$ linear or branched hydrocarbyl groups.

In some preferred embodiments, in the structural formula (I):

$R_1$ is a $C_{2-20}$ divalent hydrocarbyl group, preferably a $C_{2-8}$ divalent hydrocarbyl group;

$R_2$ is a moiety having the structure of —$R_3$—C(=O)—O—$R_4$;

$R_3$ is a $C_{8-24}$ divalent hydrocarbyl group having 0-5 carbon-carbon double bonds, preferably a $C_{16-22}$ divalent hydrocarbyl group having 0-3 carbon-carbon double bonds; and $R_4$ is hydrogen or a $C_{1-10}$ hydrocarbyl group, preferably hydrogen or a $C_{1-4}$ hydrocarbyl group.

In some further preferred embodiments, the dicarboxylic acid monoester of component A is selected from dicarboxylic acid monoesters represented by the formula (I-1), (I-2), or (I-3):

(I-1)

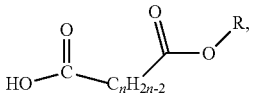

wherein n is an integer from 2 to 6, R is a $C_{3-20}$ hydrocarbyl group, preferably a $C_{4-18}$ hydrocarbyl group;

(I-2)

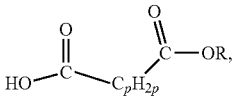

wherein p is an integer from 1 to 8, R is a $C_{3-20}$ hydrocarbyl group, preferably a $C_{4-18}$ hydrocarbyl group;

(I-3)

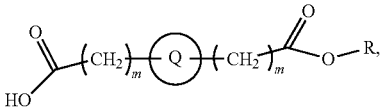

wherein m is an integer of 0 to 1, Q is a $C_{3-8}$ divalent alicyclic hydrocarbyl group or a $C_{6-10}$ substituted or unsubstituted divalent aryl group, and R is a $C_{3-20}$ hydrocarbyl group, preferably a $C_{4-18}$ hydrocarbyl group.

According to the present application, in the structural formula (I-1), (I-2) or (1-3), R may be an aliphatic hydrocarbyl group, an alicyclic hydrocarbyl group or an aryl group. The aliphatic hydrocarbyl group may be linear or branched; may be saturated aliphatic hydrocarbyl group or unsaturated aliphatic hydrocarbyl group; the unsaturated aliphatic hydrocarbyl group may be an aliphatic hydrocarbyl group having at least one carbon-carbon double bond (ethylenic bond) or at least one carbon-carbon triple bond (acetylenic bond). The alicyclic hydrocarbyl group may be a saturated alicyclic hydrocarbyl group (cycloalkyl group) or an unsaturated alicyclic hydrocarbyl group. The aryl group may be a monocyclic aryl group, or may be a bicyclic or polycyclic aryl group. The alicyclic and aryl groups may also bear various hydrocarbyl substituents on the carbon ring.

In a further preferred embodiment, in the structural formulae (I-1), (I-2) and (I-3), R is selected from $C_{3-20}$ linear or branched aliphatic hydrocarbyl groups, $C_{4-20}$ alicyclic hydrocarbyl groups, $C_{7-20}$ aryl-substituted hydrocarbyl groups or $C_{7-20}$ hydrocarbyl-substituted aryl group, preferably a $C_{4-18}$ linear or branched alkyl group.

In the present application, where R is a saturated linear or branched aliphatic hydrocarbyl group, R may be a normal alkyl group or an isomeric alkyl group. Where R is a n-alkyl group, it is preferably methyl group, ethyl group, n-propyl group, n-butyl group, n-pentyl group, n-hexyl group, n-heptyl group, n-octyl group, n-nonyl group, n-decyl group, n-undecyl group, mono-n-dodecyl group (lauryl ester group), n-tetradecyl group, n-hexadecyl group, n-octadecyl group or the like, more preferably n-butyl group, n-hexyl group, n-octyl group, n-nonyl group, n-decyl group. Where R is an isomeric alkyl group, it is preferably isopropyl, isobutyl, sec-butyl, isopentyl, isohexyl, isoheptyl, isooctyl (especially 2-ethylhexyl), isononyl, isodecyl, isoundecyl, isotridecyl, isopentadecyl, isoheptadecyl and the like, more preferably sec-butyl, isooctyl (especially 2-ethylhexyl), isononyl, isodecyl, isoundecyl and isotridecyl.

In the present application, where R is an unsaturated linear or branched aliphatic hydrocarbyl group, it is preferably allyl, 2-butenyl, 3-butenyl, isopentenyl, 3-hexenyl, 2-octenyl, 3-nonenyl, 2-decenyl, 7-dodecenyl, 1,5-hexadienyl, 2,4-nonadienyl, 2,4-decadienyl, 9,11-dodecadienyl, 9-octadecenyl, more preferably 3-hexenyl, 2-octenyl, 3-nonenyl, isopentenyl, 9-octadecenyl.

In the present application, where R is an alicyclic hydrocarbyl group, it is preferably cyclobutyl, cyclopentyl, cyclohexyl, 3-cyclohexenyl, 2-cyclohexenyl or the like, more preferably cyclopentyl, cyclohexyl, 3-cyclohexenyl or 2-cyclohexenyl.

In the present application, where R is an unsubstituted aryl group, it is preferably phenyl group; where R is a hydrocarbyl-substituted aryl group, it is preferably methylphenyl, p-nonylphenyl, p-dodecylphenyl, or the like; where R is an aryl-substituted hydrocarbyl group, it is preferably benzyl (phenmethyl), phenethyl, p-dodecylphenyl or the like, more preferably benzyl (phenmethyl), p-nonylphenyl, p-dodecylphenyl.

According to the present application, the dicarboxylic acid monoester represented by the formula (I-1) is an unsaturated dicarboxylic acid monoester obtained through the esterification of one carboxyl group of a $C_{4-8}$ linear or branched dicarboxylic acid having one carbon-carbon unsaturated double bond.

Specifically, where n is 2, the dicarboxylic acid monoester represented by the formula (I-1) is maleic acid monoester (i.e., monoester of cis-butenedioic acid), fumaric acid monoester (i.e., monoester of trans-butenedioic acid); where n is 3, the dicarboxylic acid monoester represented by the formula (I-1) is itaconic acid monoester, citraconic acid monoester (i.e., methyl maleic acid monoester), methyl fumaric acid monoester (i.e., monoester of methyl trans-butenedioic acid), glutaconic acid monoester, or the like; where n is 4, the dicarboxylic acid monoester represented by the formula (1-1) is preferably 2,3-dimethylmaleic acid monoester, ethylmaleic acid monoester, hexenedioic acid monoester, or the like.

Preferably, the dicarboxylic acid monoester represented by the formula (I-1) is selected from maleic acid monoester, fumaric acid monoester, itaconic acid monoester, citraconic acid monoester, methyl fumaric acid monoester, 2,3-dimethylmaleic acid monoester, glutaconic acid monoester, and the like, and more preferably selected from maleic acid monoester and itaconic acid monoester.

Further preferably, the dicarboxylic acid monoester represented by the formula (I-1) is selected from maleic acid monoesters represented by the formula (I-1-1), (I-1-1)

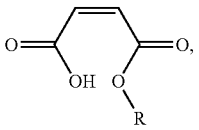

itaconic acid monoesters represented by the formula (I-1-2), (I-1-2)

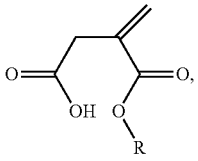

or itaconic acid monoesters represented by the formula (I-1-3), (I-1-3)

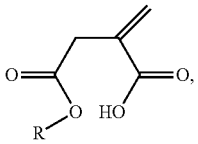

wherein R is as defined above.

Particularly preferably, where R is a n-alkyl group, the maleic acid monoester of the formula (I-1-1) may be selected from monomethyl maleate, monoethyl maleate, mono-n-propyl maleate, mono-n-butyl maleate, mono-n-pentyl maleate, mono-n-hexyl maleate, mono-n-heptyl maleate, mono-n-octyl maleate, mono-n-nonyl maleate, mono-n-decyl maleate, mono-n-undecyl maleate, mono-n-dodecyl maleate (lauryl ester), mono-n-tetradecyl maleate, mono-n-hexadecyl maleate, mono-n-octadecyl maleate, and the like, preferably from monomethyl maleate, monoethyl maleate, mono-n-propyl maleate, mono-n-butyl maleate, mono-n-octyl maleate, mono-n-nonyl maleate, mono-n-decyl maleate, mono-n-dodecyl maleate, and the like, more preferably from mono-n-butyl maleate, mono-n-pentyl, mono-n-octyl maleate, mono-n-nonyl maleate, mono-n-decyl maleate, and the like; the itaconic acid monoester represented by the formula (I-1-2) or (I-1-3) may be selected from monomethyl itaconate, monoethyl itaconate, mono-n-propyl itaconate, mono-n-butyl itaconate, mono-n-pentyl itaconate, mono-n-hexyl itaconate, mono-n-heptyl itaconate, mono-n-octyl itaconate, mono-n-nonyl itaconate, mono-n-decyl itaconate, mono-n-undecyl itaconate, mono-n-dodecyl itaconate (lauryl itaconate), mono-n-tetradecyl itaconate, mono-n-hexadecyl itaconate, monon-n-octadecyl itaconate, and the like, preferably from monomethyl itaconate, monoethyl itaconate, mono-n-propyl itaconate, mono-n-butyl itaconate, mono-n-octyl itaconate, mono-n-decyl itaconate, mono-n-dodecyl itaconate (lauryl itaconate), mono-n-octadecyl itaconate, and the like, more preferably from mono-n-butyl itaconate, mono-n-pentyl itaconate, mono-n-octyl itaconate, mono-n-nonyl itaconate, mono-n-decyl itaconate.

Particularly preferably, where R is an isomeric alkyl group, the maleic acid monoester represented by the formula (I-1-1) may be selected from monoisopropyl maleate, monoisobutyl maleate, mono-sec-butyl maleate, mono-tert-butyl maleate, monoisoamyl maleate, monoisohexyl maleate, monoisooctyl maleate (mono-2-ethylhexyl maleate), monoisononyl maleate, monoisodecyl maleate, monoisoundecyl maleate, monoisododecyl maleate, monoisotridecyl maleate, monoisotetradecyl maleate, monoisopentadecyl maleate, monoisoheptadecyl maleate, and the like, preferably from monoisopropyl maleate, monoisobutyl maleate, mono-sec-butyl maleate, monoisooctyl maleate, monoisononyl maleate, monoisodecyl maleate, monoisoundecyl maleate, monoisotridecyl maleate, monoisooctadecyl maleate, and the like, more preferably from mono-tert-butyl maleate, mono-sec-butyl maleate, monoisoamyl maleate, monoisooctyl maleate (mono-2-ethylhexyl maleate), monoisononyl maleate, monoisoundecyl maleate, monoisotridecyl maleate; the itaconic acid monoester represented by the formula (I-1-2) or (I-1-3) may be selected from monoisopropyl itaconate, monoisobutyl itaconate, mono-sec-butyl itaconate, mono-tert-butyl itaconate, monoisoamyl itaconate, monoisohexyl itaconate, monoisooctyl itaconate (mono-2-ethylhexyl itaconate), monoisononyl itaconate, monoisodecyl itaconate, monoisoundecyl itaconate, monoisotridecyl itaconate and the like, preferably from monoisopropyl itaconate, monoisobutyl itaconate, monoisooctyl itaconate (mono-2-ethylhexyl itaconate), monoisononyl itaconate, monoisodecyl itaconate, monoisoundecyl itaconate, monoisostearyl itaconate and the like, more preferably from monotert-butyl itaconate, monoisoamyl itaconate, monoisohexyl itaconate, monoisooctyl itaconate (mono-2-ethylhexyl itaconate), monoisononyl itaconate, monoisoundecyl itaconate.

Particularly preferably, where R is an unsaturated linear or branched aliphatic hydrocarbyl group, the maleic acid monoester of formula (I-1-1) may be selected from monoallyl maleate, mono-3-buten-1-ol maleate, monoisopropenyl maleate, mono-3-hexen-1-ol maleate, mono-1-hepten-3-ol maleate, monomethylheptenyl maleate, mono-2-octen-1-ol maleate, mono-3-nonen-1-ol maleate, mono-2-decen-1-ol maleate, mono-7-dodecen-1-ol maleate, mono-1,5-hexadienol maleate, mono-2,4-nonadien-1-ol maleate, mono-2,4-decadien-1-ol maleate, mono-9,11-dodecadienol maleate, monooleyl maleate and the like, preferably from monoallyl maleate, mono-3-butene-1-ol maleate, monoisopropenyl maleate, mono-3-hexene-1-ol maleate, mono-1-hepten-3-ol maleate, monomethylheptenyl maleate, mono-3-nonen-1-ol maleate, mono-2,4-decadien-1-ol maleate, monooleyl maleate and the like, more preferably from mono-2-octene-1-ol maleate, mono-3-nonen-1-ol maleate, mono-2-decen-1-ol maleate, monooleyl maleate and the like; the itaconic acid monoester represented by the formula (I-1-2) or (I-1-3) may be selected from monoallyl itaconate, mono-2-butene-1-ol itaconate, mono-3-butene-1-ol itaconate, mono-isopropenyl itaconate, mono-3-hexene-1-ol itaconate, mono-1-hepten-3-ol itaconate, monomethylheptenyl itaconate, mono-2-octene-1-ol itaconate, mono-3-nonene-1-ol itaconate, mono-2-decene-1-ol itaconate, mono-7-dodecene-1-ol itaconate, mono-1,5-hexadienol itaconate, mono-2,4-nonadiene-1-ol itaconate, mono-2,4-decadienol itaconate, mono-9,11-dodecadienol itaconate, monooleyl itaconate, and the like, preferably from mono-allyl itaconate, mono-3-butene-1-ol itaconate, mono-isopropenyl itaconate, mono-3-hexene-1-ol itaconate, mono-3-nonen-1-ol itaconate, monooleyl itaconate, and the like, more preferably from mono-2-octene-1-ol itaconate, mono-3-nonen-1-ol itaconate, monooleyl itaconate.

Particularly preferably, where R is an alicyclic hydrocarbyl group, the maleic acid monoester of the formula (I-1-1) may be selected from monocyclobutyl maleate, monocyclopentyl maleate, monocyclohexyl maleate, mono-3-cyclohexen-1-methyl maleate, mono-2-cyclohexenyl maleate or the like; the itaconic acid monoester represented by the formula (I-1-2) or (I-1-3) may be selected from itaconic acid monocyclohexyl ester, itaconic acid mono-2-cyclohexenyl ester or the like.

Particularly preferably, where R is a hydrocarbyl-substituted aryl group, the maleic acid monoester of the formula (I-1-1) may be selected from mono-p-nonylphenyl maleate, mono-p-dodecylphenyl maleate, and the like; the itaconic acid monoester represented by the formula (I-1-2) or (I-1-3) may be selected from mono-p-nonylphenyl itaconate, mono-p-dodecylphenyl itaconate.

Particularly preferably, where R is an aryl-substituted hydrocarbyl group, the maleic acid monoester of the formula (I-1-1) may be selected from monobenzyl maleate, monophenylethyl maleate, monophenylpropyl maleate; the itaconic acid monoester represented by the formula (I-1-2) or (I-1-3) may be selected from monobenzyl itaconate, monophenylethyl maleate, monophenylpropyl maleate.

According to the present application, the dicarboxylic acid monoester represented by the formula (I-2) is a dicarboxylic acid monoester obtained through the esterification of one carboxyl group of a $C_{3-10}$ saturated linear or branched dicarboxylic acid.

In a further preferred embodiment, the dicarboxylic acid monoester represented by the formula (I-2) is a monoester of a saturated linear dicarboxylic acid, i.e., a dicarboxylic acid monoester of the formula (I-2) in which the carbon chain between two carbonyl groups is a saturated linear chain.

Particularly preferably, the dicarboxylic acid monoester represented by the formula (I-2) is selected from malonic acid monoester, succinic acid monoester (i.e., succinic acid monoester), glutaric acid monoester, adipic acid monoester, pimelic acid monoester, suberic acid monoester, azelaic acid monoester, sebacic acid monoester, undecanedioic acid monoester, dodecanedioic acid monoester, tridecanedioic acid monoester, tetradecanedioic acid monoester, hexadecanedioic acid monoester, octadecanedioic acid monoester, and the like.

Particularly preferably, the dicarboxylic acid monoester represented by the formula (I-2) is selected from malonic acid monoester, succinic acid monoester, glutaric acid monoester, adipic acid monoester, azelaic acid monoester and sebacic acid monoester.

As examples of the malonic acid monoester, monomethyl malonate, monoethyl malonate, monopropyl malonate, mono-n-butyl malonate, mono-n-hexyl malonate, mono-n-octyl malonate, mono-n-decyl malonate, mono-n-dodecyl malonate (lauryl ester), mono-isobutyl malonate, mono-t-butyl malonate, mono-isooctyl malonate, mono-isononyl malonate, mono-isodecyl malonate, mono-isoundecyl malonate, mono-iso-tridecyl malonate, mono-oleyl malonate (mono-9-octadecenyl malonate), monocyclohexyl malonate, mono-3-cyclohexen-1-methyl malonate, mono-p-nonylphenyl malonate, mono-benzyl malonate or the like are more preferable.

As examples of the succinic acid monoester, mono-n-butyl succinate, mono-sec-butyl succinate, mono-n-hexyl succinate, mono-n-octyl succinate, mono-n-decyl succinate, mono-n-dodecyl succinate (lauryl ester), mono-isobutyl succinate, mono-tert-butyl succinate, mono-isoamyl succinate, mono-isohexyl succinate, mono-isooctyl succinate, mono-isononyl succinate, mono-isodecyl succinate, mono-isoundecyl succinate, mono-isotridecyl succinate, mono-oleyl succinate (mono-9-octadecenyl succinate), monocyclohexyl succinate, mono-3-cyclohexene-1-methyl succinate, mono-p-nonylphenyl succinate, and mono-benzyl succinate are more preferable.

As examples of the glutaric acid monoester, monomethyl glutarate, monoethyl glutarate, monopropyl glutarate, mono-n-butyl glutarate, mono-n-hexyl glutarate, mono-n-octyl glutarate, mono-n-decyl glutarate, mono-n-dodecyl glutarate (lauryl ester), mono-isobutyl glutarate, mono-t-butyl glutarate, monoisooctyl glutarate, monoisononyl glutarate, monoisodecyl glutarate, monoisoundecyl glutarate, monoisotridecyl glutarate, monooleyl glutarate (mono-9-octadecenyl glutarate), monocyclohexyl glutarate, mono-3-cyclohexen-1-methyl glutarate, mono-p-nonylphenyl glutarate, monobenzyl glutarate and the like are more preferable.

As examples of the adipic acid monoester, monomethyl adipate, monoethyl adipate, mono-n-butyl adipate, mono-n-hexyl adipate, mono-n-octyl adipate, mono-n-decyl adipate, mono-n-dodecyl adipate (lauryl ester), monopropyl adipate, monoisobutyl adipate, monoisooctyl adipate, monoisononyl adipate, monoisodecyl adipate, monoisoundecyl adipate, monoisotridecyl adipate, monooleyl adipate (mono-9-octadecenyl adipate), monocyclohexyl adipate, mono-3-cyclohexene-1-methyl adipate, mono-p-nonylphenyl adipate, monobenzyl adipate and the like are more preferable.

As examples of the azelaic acid monoester, monomethyl azelate, monoethyl azelate, monopropyl azelate, mono-n-butyl azelate, mono-n-hexyl azelate, mono-n-octyl azelate, mono-n-decyl azelate, mono-n-dodecyl azelate (lauryl ester), monoisobutyl azelate, monoisooctyl azelate, monoisononyl azelate, monoisodecyl azelate, monoisoundecyl azelate, monoisotridecyl azelate, monooleyl azelate (mono-9-octadecenyl azelate), monocyclohexyl azelate, mono-3-cyclohexene-1-methyl azelate, mono-p-nonylphenyl azelate, monobenzyl azelate and the like are more preferable.

As examples of the sebacic acid monoester, monomethyl sebacate, monoethyl sebacate, monopropyl sebacate, mono-n-butyl sebacate, mono-n-hexyl sebacate, mono-n-octyl sebacate, mono-n-decyl sebacate, mono-n-dodecyl sebacate (lauryl ester), monoisobutyl sebacate, monoisooctyl sebacate, monoisononyl sebacate, monoisodecyl sebacate, monoisoundecyl sebacate, monoisotridecyl sebacate, monooleyl sebacate (mono-9-octadecenyl sebacate), monocyclohexyl sebacate, mono-3-cyclohexene-1-methyl sebacate, mono-p-nonylphenyl sebacate, monobenzyl sebacate and the like are more preferable.

According to the present application, the dicarboxylic acid monoester represented by the formula (1-3) is a dicarboxylic acid monoester obtained through the esterification of one carboxyl group of a $C_{5-12}$ dicarboxylic acid comprising an optionally substituted saturated or unsaturated carbon ring structure having 3 to 10 carbon atoms in the main chain. Preferably, m is 0, Q is a substituted or unsubstituted $C_{4-8}$ divalent alicyclic hydrocarbyl group or a substituted or unsubstituted divalent $C_{6-10}$ aryl group, and R is a $C_{4-12}$ hydrocarbyl group.

Particularly preferably, the dicarboxylic acid monoester represented by the formula (1-3) is selected from 1,2-cyclohexanedicarboxylic acid monoester, tetrahydrophthalic acid monoester (i.e., 4-cyclohexene-1,2-dicarboxylic acid monoester), phthalic acid monoester, terephthalic acid monoester, 3-methylhexahydrophthalic acid monoester (i.e., 3-methyl-1,2-cyclohexanedicarboxylic acid monoester), 4-methylhexahydrophthalic acid monoester (i.e., 4-methyl-1,2-cyclohexanedicarboxylic acid monoester), methylhexahydrophthalic acid monoester, methyltetrahydrophthalic acid monoester, 4-methyl-4-cyclohexene-1,2-dicarboxylic acid monoester, and 3-methyl-4-cyclohexene-1,2-dicarboxylic acid monoester and the like.

Further particularly preferably, the dicarboxylic acid monoester represented by the formula (I-3) is selected from 1,2-cyclohexanedicarboxylic acid monoester, tetrahydrophthalic acid monoester, phthalic acid monoester, methylhexahydrophthalic acid monoester and methyltetrahydrophthalic acid monoester, for example, 1,2-cyclohexanedicarboxylic acid monobutyl ester, 1,2-cyclohexanedicarboxylic acid monooctyl ester, 1,2-cyclohexanedicarboxylic acid monoisooctyl ester, 1,2-cyclohexanedicarboxylic acid monoisononyl ester, tetrahydrophthalic acid monobutyl ester, tetrahydrophthalic acid monooctyl ester, tetrahydrophthalic acid monoisooctyl ester, tetrahydrophthalic acid monoisononyl ester, phthalic acid monobutyl ester, phthalic acid monooctyl ester, phthalic acid monoisooctyl ester, phthalic acid monoisononyl ester, methylhexahydrophthalic acid monobutyl ester, methyl-hexahydrophthalic acid mono-octyl ester, methyl-hexahydrophthalic acid mono-isooctyl ester, methyl-hexahydrophthalic acid mono-isononyl ester, methyl-hexahydrophthalic acid monolauryl ester, methyl-tetrahydrophthalic acid mono-butyl ester, methyl-tetrahydrophthalic acid mono-octyl ester, methyl-tetrahydrophthalic acid mono-isooctyl ester, methyl-tetrahydrophthalic acid mono-isononyl ester, methyl-tetrahydrophthalic acid monolauryl ester, and the like.

In some particularly preferred embodiments, the dicarboxylic acid monoester of the formula (I-1), (I-2), or (I-3) is selected from monobutyl maleate, monoisooctyl maleate, monoisononyl maleate, monoisooctyl succinate, monohexyl phthalate, monoisooctyl phthalate, monoisooctyl methyltetrahydrophthalate, monoisooctyl citraconate, monoisooctyl itaconate, mono-tert-butyl malonate. Most preferably, the dicarboxylic acid monoester is selected from monobutyl maleate, monoisooctyl maleate, monoisononyl maleate, monoisooctyl itaconate, monoisooctyl succinate, monohexyl phthalate, monoisooctyl phthalate, monoisooctyl methyltetrahydrophthalate, mono-tert-butyl malonate.

According to the present application, the dicarboxylic acid monoester represented by the formula (I-1), (I-2) or (I-3) can be obtained by reacting a saturated dicarboxylic acid, an unsaturated dicarboxylic acid, a cyclic dicarboxylic acid or a benzenedicarboxylic acid or an acid anhydride thereof with a $C_{3-20}$ alcohol or phenol. The reaction conditions include: reacting the dicarboxylic acid or anhydride with a $C_{2-20}$ alcohol or phenol at a molar ratio of 1:0.5 to 1:1.5 at 50-250° C. for 0.1-10 hr, and a reaction pressure of normal pressure or a certain pressure.

In some further preferred embodiments, the dicarboxylic acid monoester of component A is selected from dicarboxylic acid monoesters represented by the formula (I-4):

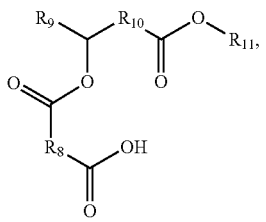

(I-4)

wherein $R_8$ is a $C_{2-10}$ divalent hydrocarbyl group; $R_9$ is hydrogen or a hydrocarbyl group with or without a double bond, $R_{10}$ is a divalent hydrocarbyl group with or without a double bond, and the total number of carbon atoms of $R_9$ and $R_{10}$ is 15-21; $R_{11}$ is hydrogen or a $C_{1-10}$ hydrocarbyl group.

In a further preferred embodiment, the total number of carbon atoms of $R_9$ and $R_{10}$ is 15 to 21 and the total number of double bonds is 0 to 3, for example $R_9$ and $R_{10}$ may each be independently selected from alkyl, alkenyl, dienyl or the like.

In a further preferred embodiment, Ru is hydrogen or a $C_{1-4}$ hydrocarbyl group, including $C_{1-4}$ alkyl group and $C_{2-4}$ alkenyl group, such as methyl, ethyl, n-propyl, propenyl, n-butyl, isobutyl, butenyl and the like, most preferably hydrogen, methyl or ethyl.

In a further preferred embodiment, $R_8$ can be alkylene, alkenylene, alkyl-substituted alkylene, alkyl-substituted alkenylene, alkenyl-substituted alkylene, alkenyl-substituted alkenylene, cycloalkylene, alkyl-substituted cycloalkylene, alkenyl-substituted cycloalkylene, cycloalkenylene, alkyl-substituted cycloalkenylene, alkenyl-substituted cycloalkenylene, arylene, alkyl-substituted arylene, or alkenyl-substituted arylene having 2 to 10 carbon atoms; the alkylene group may be a normal alkylene group or an isomeric alkylene group, and the alkenylene group may be a normal alkenylene group or an isomeric alkenylene group; more preferably, $R_8$ is $C_{2-8}$ alkylene, $C_{2-8}$ alkenylene, $C_{2-8}$ alkyl- or alkenyl-substituted alkylene, $C_{2-8}$ alkyl- or alkenyl-substituted alkenylene, $C_{3-8}$ cycloalkylene, $C_{3-8}$ cycloalkenylene, $C_{6-8}$ alkyl- or alkenyl-substituted cycloalkylene, $C_{6-8}$ alkyl- or alkenyl-substituted cycloalkenylene, $C_{6-10}$ arylene, $C_{7-10}$ alkyl- or alkenyl-substituted arylene, such as ethylene, vinylene, methylene ethylene, methyl ethylene, butylene, methyl butylene, butenylene, phenylene, cyclohexylene, methyl hexahydrophenylene, methyl tetrahydrophenylene or the like.

In a still further preferred embodiment, in the structural formula (I-4), $R_8$ is a $C_{2-8}$ divalent hydrocarbyl group; $R_9$ is hydrogen or a hydrocarbyl group, $R_{10}$ is a divalent hydrocarbyl group, and the total number of carbon atoms of $R_9$ and $R_{10}$ is 15-21, and the total number of carbon-carbon double bonds is 0-3; $R_{11}$ is hydrogen or a $C_{1-4}$ hydrocarbyl group.

According to the present application, the dicarboxylic acid monoester represented by the formula (I-4) can be obtained by subjecting a hydroxy fatty acid and/or a hydroxy fatty acid ester (referred to as "hydroxy fatty acid (ester)" for short) to an esterification reaction with a dicarboxylic acid and/or an acid anhydride thereof. The esterification reaction conditions may include: a temperature in a range of 30-300° C., preferably 50-250° C., and more preferably 70-180° C.; a reaction time of 0.5 to 30 hours, preferably 2 to 20 hours, more preferably 4 to 10 hours. The esterification reaction is optionally carried out in the presence of a solvent, which may be toluene, xylene, ethylbenzene, petroleum ether, solvent oil, cyclohexane, n-octane, or mixtures thereof, and a catalyst, which may be an acid catalyst, such as sulfuric acid, p-toluenesulfonic acid, phosphoric acid, boric acid or the like.

As an example, the hydroxy fatty acid may be selected from hydroxyoctadecanoic acid (hydroxystearic acid), hydroxyoctadecenoic acid (ricinoleic acid), hydroxyoctadecadienoic acid, hydroxydocosanoic acid, hydroxydocosenoic acid, hydroxytetracosanoic acid, hydroxytetracosenic acid, and the like, preferably from ricinoleic acid, hydroxystearic acid, and hydroxyoctadecadienoic acid.

As an example, the hydroxy fatty acid ester may be selected from methyl hydroxyoctadecanoate (methyl hydroxystearate), methyl hydroxyoctadecenoate (methyl ricinoleate), ethyl ricinoleate, methyl hydroxyoctadecadienoate, methyl hydroxydocosanoate, methyl hydroxydocosenoate, methyl hydroxytetracosanoate, methyl hydroxytetracosenate, and the like, preferably from methyl ricinoleate, methyl transricinoleate, ethyl ricinoleate, and methyl hydroxyoctadecadienoate.

As an example, the dicarboxylic acid may be a saturated dicarboxylic acid, for example, one or more selected from succinic acid (succinic acid), glutaric acid, adipic acid, pimelic acid, suberic acid, azelaic acid, sebacic acid, undecanedioic acid, dodecanedioic acid, and the like; preferably one or more selected from succinic acid, methylsuccinic acid, dimethylsuccinic acid, octylsuccinic acid.

Alternatively, the dicarboxylic acid may be an unsaturated dicarboxylic acid, for example selected from cis-butenedioic acid (maleic acid), trans-butenedioic acid (fumaric acid), cis-methylbutenedioic acid (citraconic acid), trans-methylbutenedioic acid (mesaconic acid), dimethylmaleic acid, itaconic acid (methylenesuccinic acid, methylenebutanedioic acid), glutaconic acid, trans-3-hexenedioic acid, butynedioic acid, 2-butene-1,4-dicarboxylic acid, hexadiene diacid, heptene diacid, octene diacid, nonene diacid, decene diacid, sebacene diacid, undecenedioic acid, dodecene diacid, and the like; it may also be one or more selected from pentenyl succinic acid, hexadienyl succinic acid, heptenyl succinic acid, octenyl succinic acid, nonenyl succinic acid, decenyl succinic acid, and the like, and preferably one or more selected from cis-butenedioic acid (maleic acid), trans-butenedioic acid (fumaric acid), cis-methylbutenedioic acid (citraconic acid), trans-methylbutenedioic acid (mesaconic acid), dimethylmaleic acid, itaconic acid (methylenesuccinic acid, methylenebutanedioic acid), 2-butene-1,4-dicarboxylic acid, decenyl succinic acid, and the like.

As an example, the acid anhydride of the saturated dicarboxylic acid may be selected from butanedioic anhydride (succinic anhydride), glutaric anhydride, adipic anhydride, phthalic anhydride, hexahydrophthalic anhydride, tetrahydrophthalic anhydride, methyl hexahydrophthalic anhydride, methyl tetrahydrophthalic anhydride, and the like; it may also be one or more of methylglutaric anhydride, methylsuccinic anhydride, dimethylsuccinic anhydride, ethylsuccinic anhydride, propylsuccinic anhydride, butylsuccinic anhydride, pentylsuccinic anhydride, hexylsuccinic anhydride, heptylsuccinic anhydride, octylsuccinic anhydride, nonylsuccinic anhydride, decylsuccinic anhydride, and the like, preferably one or more selected from cis-butenedioic acid anhydride (maleic anhydride), 2,3-dimethylmaleic anhydride, citraconic anhydride, itaconic anhydride, glutaconic anhydride, and the like.

As an example, the anhydride of the unsaturated dicarboxylic acid may be one or more selected from (2-methyl-2-propenyl) succinic anhydride, vinyl succinic anhydride, propenyl succinic anhydride, butenyl succinic anhydride, triisobutenyl succinic anhydride, pentenyl succinic anhydride, 3-methyl-hexenyl succinic anhydride, heptenyl succinic anhydride, octenyl succinic anhydride, nonenyl succinic anhydride, decenyl succinic anhydride, and the like.

Particularly preferably, the anhydride of the dicarboxylic acid is one or more selected from maleic anhydride, citraconic anhydride, itaconic anhydride, succinic anhydride, glutaric anhydride, phthalic anhydride, hexahydrophthalic anhydride, tetrahydrophthalic anhydride, methyl hexahydrophthalic anhydride, methyl tetrahydrophthalic anhydride, methyl succinic anhydride, dimethyl succinic anhydride, nonyl succinic anhydride, decyl succinic anhydride, nonenyl succinic anhydride, decenyl succinic anhydride, and the like.

In a particularly preferred embodiment, the dicarboxylic acid monoester compound represented by the formula (I-4) is selected from the group consisting of maleic acid monoester-substituted methyl ricinoleate, maleic acid monoester-substituted ricinoleic acid, succinic acid monoester-substituted methyl ricinoleate, succinic acid monoester-substituted ricinoleic acid, succinic acid monoester-substituted methyl 12-hydroxystearate, maleic acid monoester-substituted methyl 12-hydroxystearate, phthalic acid monoester-substituted methyl ricinoleate, methyl hexahydrophthalic acid monoester-substituted methyl ricinoleate, methyltetrahydrophthalic acid monoester-substituted methyl ricinoleate, and combinations thereof.

Component B

According to the present application, the component B is a $C_{8-24}$ long-chain fatty acid, a polyol ester of the $C_{8-24}$ long-chain fatty acid, or mixtures thereof.

As an example, the $C_{8-24}$ long-chain fatty acid may be selected from caprylic acid, capric acid, lauric acid (dodecanoic acid), myristic acid (tetradecanoic acid), palmitic acid (hexadecanoic acid), palmitoleic acid (hexadecenoic acid), stearic acid (octadecanoic acid), oleic acid (octadecenoic acid), linoleic acid (octadecadienoic acid), linolenic acid (octadecatrienoic acid), ricinoleic acid (hydroxyoctadecenoic acid), hydroxystearic acid, arachidic acid (eicosanoic acid), arachidonic acid (eicosenoic acid), behenic acid (docosanoic acid), erucic acid (docosenoic acid), and the like, and mixtures thereof.

In a preferred embodiment, the component B is selected from $C_{12-20}$ unsaturated fatty acids, polyol esters of $C_{12-20}$ unsaturated fatty acids, or mixtures thereof.

As an example, the $C_{12-20}$ unsaturated fatty acid is preferably selected from oleic acid, linoleic acid, linolenic acid, ricinoleic acid, or combinations thereof, or selected from fatty acid mixtures containing oleic acid, linoleic acid, linolenic acid, and ricinoleic acid as main ingredient.

Natural oil or waste oil can be hydrolyzed to produce various fatty acid mixtures, and can be converted to unsaturated fatty acid-based products by distillation or urea inclusion, low-temperature freezing crystallization, and biodiesel can also be converted to unsaturated fatty acid by hydrolysis after distillation or urea inclusion, low-temperature freezing crystallization. Tall oil fatty acids derived from the paper industry contain a large amount of unsaturated fatty acids. These products are all preferred component B. An unsaturated fatty acid mixture obtained by hydrolyzing and refining tall oil, cottonseed oil, cottonseed acidified oil, soybean oil, soybean acidified oil or the like used as starting materials is also a preferable component B, and examples thereof include unsaturated fatty acid JC2006S available from Jiangsu Chuangxin Petrochemical Co., Ltd., unsaturated fatty acid KMJ-031 available from Xinjiang Dasen Chemical Co., Ltd., and unsaturated fatty acid R90 available from Jiangxi Xilinke Co., Ltd., and the like.

According to the present application, the polyol ester of long-chain fatty acid refers to various esterified products, such as mono-, di- and tri-esters and mixtures thereof, obtained by esterification of the above long-chain saturated or unsaturated fatty acid with a polyol.

As an example, the polyol may include, but is not limited to, ethylene glycol, glycerol (glycerin), 1,2-propanediol, 1,3-propanediol, sorbitan, pentaerythritol, trimethylolpropane, and the like, with glycerol being preferred.

In a preferred embodiment, the polyol ester is a glycerol ester, preferably selected from monoglycerides and diglycerides, more preferably a monoglyceride of an unsaturated fatty acid, most preferably selected from monoglycerol oleate, monoglycerol linoleate, monoglycerol linolenate, monoglycerol ricinoleate. It is preferable to use, as component B, a glyceride obtained by esterification of an unsaturated fatty acid with glycerol, such as JC-2017Z available from Jiangsu Chuangxin Petrochemical Co., Ltd., and the like.

In a second aspect, there is provided a method for preparing the lubricity improver composition for fuel oil of the present application, comprising uniformly mixing the component A with the component B in a mass ratio of from 9:1 to 1:9, preferably from 7:3 to 3:7, more preferably from 6:4 to 4:6.

In a third aspect, the present application provides a method for improving the lubricity of diesel fuel, comprising adding to a low-sulfur diesel fuel the lubricity improver composition for fuel oil according to the present application, wherein the lubricity improver composition for fuel oil is preferably added in an amount of from 10 to 400 ppm, more preferably from 50 to 200 ppm, based on the mass of the low-sulfur diesel fuel.

In a fourth aspect, the present application provides a diesel fuel composition comprising a low-sulfur diesel fuel and the lubricity improver composition for fuel oil according to the present application, wherein the lubricity improver composition for fuel oil is preferably present in the diesel fuel composition in an amount of from 10 to 400 ppm, more preferably from 50 to 200 ppm, based on the mass of the low-sulfur diesel fuel.

Low-sulfur diesel fuels suitable for use with the lubricity improver of the present application include various low-sulfur diesel fuels. For example, the diesel fuel can be a compression ignition type internal combustion engine fuel satisfying the National standard GB/T19147 for automobile diesel fuels, prepared by processing crude oil (petroleum) through various refining processes of an oil refinery, such as atmospheric and vacuum distillation, catalytic cracking, catalytic reforming, coking, hydrofining, hydrocracking and the like, to produce a fraction having a distillation range of between 160° C. and 380° C. and then blending.

The low-sulfur diesel may also be a second generation biodiesel derived from renewable resources, such as vegetable oils and animal fats, which is typically obtained by hydrogenation of vegetable oils to produce isomerized or non-isomerized long chain hydrocarbons using hydrotreating process typically used in refineries, and may be similar in nature and quality to petroleum-based fuel oils.

The low-sulfur diesel can also be a third generation biodiesel, which is prepared by processing non-oil biomass with high cellulose content, such as sawdust, crop straws, solid waste and the like, and microbial oil using gasification and Fischer-Tropsch technology.

The low-sulfur diesel may also be coal-to-liquid diesel (CTL), which refers to a diesel fuel obtained by fischer-tropsch synthesis of coal, or a diesel fuel obtained by direct liquefaction of coal. It may also be a mixed diesel fuel obtained by adding an oxygen-containing diesel fuel blending component to petroleum-based diesel fuel, wherein the oxygen-containing diesel fuel blending component refers to an oxygen-containing compound or a mixture of oxygen-containing compounds which can be blended with various diesel fuels to meet certain specification requirements, and is typically alcohols and ethers or a mixture thereof, such as ethanol, Polyoxymethylene dimethyl ethers (PODEn, DMMn or OME for short) and the like.

The diesel fuel composition of the present application may further contain other additives, such as one or more of phenol-type antioxidants, polymeric amine-type ashless dispersants, flow improvers, cetane number improvers, metal deactivators, antistatic agents, corrosion inhibitors, rust inhibitors, and demulsifiers, as required.

EXAMPLES

The preset application will now be further illustrated with reference to the following examples, but is not to be construed as being limited thereto.

In the following examples and comparative examples, reagents and starting materials used are commercially available materials of reagent pure grade, unless otherwise specified.

In the following examples and comparative examples, the infrared spectrum of the product obtained was measured by Nicolet iS50 Fourier Transform Infrared Spectrometer of Thermo Fisher Scientific.

In the following examples and comparative examples, the analysis of the composition of the product obtained was carried out using 7890A-5975C GC-MS of Agilent, with chromatographic conditions including: an initial temperature of 50° C., a heating rate of 5° C./min, a column temperature of 300° C., Flame Ionization Detector (FID), area normalization method for quantification, and a chromatographic column of HP-5.

In the following examples and comparative examples, the photograph of the wear scar of the diesel fuel before and after addition of the lubricity improver composition was obtained by measuring the Wear Scar Diameter (WSD) at 60° C. on a High-Frequency Reciprocating Rig (HFRR, PCS instruments, UK) according to the SH/T 0765 method.

Preparation of Dicarboxylic Acid Monoester

Preparation Example 1 Monoisononyl Maleate 490 g of maleic anhydride (cis-butenedioic anhydride, 99.5% by mass, available from Zibo Qixiang Tengda Chemical Co., Ltd.) and 720 g of isomeric nonanol (Exxal™ 9s, 99.5% by mass, available from Exxon-Mobil Co., Ltd.) were charged into a 2000 mL reactor equipped with an electric stirrer and a thermometer, the molar ratio of maleic anhydride to isomeric nonanol was about 1:1, the mixture was heated under stirring to 85° C., the temperature was raised to 150° C. after 5 hours of reaction, and unreacted isomeric nonanol and maleic anhydride were removed by distillation under reduced pressure to obtain 1006 g of product. The infrared spectrum of the resulting product is shown in FIG. 1, and the content of monoisononyl maleate is about 90.5% and the content of diisononyl maleate is about 8.6% as analyzed by GC-MS.

Preparation Example 2 Monoisooctyl Succinate 490 g succinic anhydride (butanedioic anhydride, 99% by mass, available from Shanghai Shenren Fine Chemical Co., Ltd.) and 700 g isooctanol (2-ethylhexanol, 99.9% by mass, available from Sinopec Qilu Petrochemical Company) were added into a 2000 mL reactor equipped with an electric stirrer, a thermometer and a reflux condenser, the molar ratio of the succinic anhydride to the isooctanol was about 1:1.1, the mixture was heated under stirring to 110° C., the temperature was raised to 160° C. after 4 hours of reaction, and unreacted isooctanol was removed by distillation under reduced pressure to obtain 1109 g of product. The content of the monoisooctyl succinate is about 86.7% as analyzed by GC-MS.

Preparation Example 3 Monoisooctyl Methyl Tetrahydrophthalate 166 g of methyltetrahydrophthalic anhydride (98% by mass, available from Shandong Yousheng Chemical Co., Ltd.) and 143 g of isooctanol (99.5% by mass, available from Sinopec Qilu Petrochemical Company) were added to a 500 mL reactor equipped with an electric stirrer and a thermometer, the molar ratio of methyltetrahydrophthalic anhydride to isooctanol was about 1:1.1, the mixture was heated under stirring to 110° C., the temperature was raised to 165° C. after 3.5 hours of reaction, and unreacted starting materials were recovered by distillation under reduced pressure to obtain 243 g of product. The content of monoisooctyl methyltetrahydrophthalate is about 85% as analyzed by GC-MS.

Preparation Example 4 Monoisooctyl Citraconate 112 g of methyl maleic anhydride (citraconic anhydride, analytically pure, available from Shanghai Aladdin Biochemical Technology Co., Ltd.) and 143 g of isooctanol (2-ethylhexanol, 99.9% by mass, available from Sinopec Qilu Petrochemical Company) were added to a 500 ml reactor equipped with an electric stirrer, a thermometer and a reflux condenser, the molar ratio of methyl maleic anhydride to isooctanol was about 1:1.1, the mixture was heated under stirring to 90° C., the temperature was raised to 140° C. after 4 hours of reaction, and unreacted isooctanol was removed by distillation under reduced pressure to obtain 245 g of a product mainly comprising monoisooctyl citraconate.

Preparation Example 5 Monoisooctyl Dodecenylsuccinate 200 g of dodecenyl succinic anhydride (analytically pure, available from Beijing Yinokai Technology Co., Ltd.) and 117 g of isooctanol (2-ethylhexanol, 99.9% by mass, available from Sinopec Qilu Petrochemical Company) were added to a 500 mL reactor equipped with an electric stirrer, a thermometer and a reflux condenser, the molar ratio of dodecenyl succinic anhydride to isooctanol was about 1:1.2, the mixture was heated under stirring to 100° C., the temperature was raised to 150° C. after 3 hours of reaction, and unreacted isooctanol was removed by distillation under reduced pressure to obtain 303 g of a product mainly comprising monoisooctyl dodecenylsuccinate.

Preparation Example 6 Maleic Acid Monoester-Substituted Methyl Ricinoleate 350.5 g of methyl ricinoleate (75% by mass, available from Shanghai Aladdin Biochemical Technology Co., Ltd.) and 100 g of maleic anhydride (cis-butenedioic anhydride, 99% by mass, available from Shanghai Aladdin Biochemical Technology Co., Ltd.) were charged into a 500 mL reactor equipped with an electric stirrer, a thermometer and a reflux condenser, and the molar ratio of methyl ricinoleate to maleic anhydride was about 1.1:1, the mixture was heated to 100° C. under stirring, and reacted for 3 hours to obtain 442.7 g of a product mainly comprising maleic acid monoester-substituted methyl ricinoleate, and the content of maleic acid monoester-substituted methyl ricinoleate is about 88% as analyzed by GC-MS.

The reaction scheme is shown in the following equation 1.

(Equation 1)

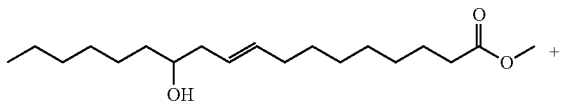

-continued

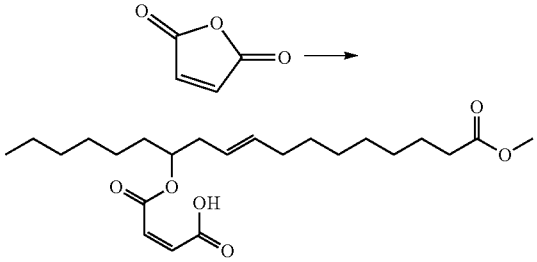

Preparation Example 7 Monoisooctyl Itaconate 200 g of methylene succinic anhydride (itaconic anhydride, analytically pure, available from Beijing Yinokai Technology Co., Ltd.) and 240.3 g of isooctanol (2-ethylhexanol, 99.9% by mass, available from Sinopec Qilu Petrochemical Company) were added to a 500 ml reactor equipped with an electric stirrer, a thermometer and a reflux condenser, the molar ratio of methylene succinic anhydride to isooctanol was about 1:1.2, the mixture was heated under stirring to 100° C., the temperature was raised to 140° C. after 3 hours of reaction, and unreacted starting materials were removed by distillation under reduced pressure to obtain 429.7 g of a product mainly comprising monoisooctyl itaconate. The content of monoisooctyl itaconate is about 84% as analyzed by GC-MS.

Preparation Example 8 Monobenzyl Maleate 150 g of maleic anhydride (cis-butenedioic anhydride, analytically pure, available from Beijing Yinokai Technology Co., Ltd.) and 198.5 g of benzyl alcohol (99% by mass, available from Beijing Yinokai Technology Co., Ltd.) were charged into a 500 mL reactor equipped with an electric stirrer, a thermometer and a reflux condenser, the molar ratio of maleic anhydride to benzyl alcohol was about 1:1.2, the mixture was heated to 80° C. under stirring, the temperature was raised to 150° C. after 5 hours of reaction, and unreacted starting materials were removed by distillation under reduced pressure to obtain 343.6 g of a product mainly comprising monobenzyl maleate. The content of monobenzyl maleate is about 88% as analyzed by GC-MS.

Preparation Example 9 Methyltetrahydrophthalic Acid Monoester-Substituted Methyl Ricinoleate 248 g of methyl ricinoleate (75% by mass, available from Shanghai Arlatin Biochemical Technology Co., Ltd.) and 100 g of methyltetrahydrophthalic anhydride (99% by mass, available from Beijing Yinokai Technology Co., Ltd.) were charged into a 500 mL reactor equipped with an electric stirrer, a thermometer and a reflux condenser, and the molar ratio of methyl ricinoleate to methyltetrahydrophthalic anhydride was about 1.1, and the mixture was heated to 140° C. under stirring, and reacted for 3 hours to obtain 329.1 g of a product mainly comprising methyltetrahydrophthalic monoester-substituted methyl ricinoleate. The content of methyltetrahydrophthalic monoester-substituted ricinoleate is about 77%, as analyzed by GC-MS.

Examples of Lubricity Improver Compositions

Lubricity improver compositions of Examples 1 to 32 and Comparative Examples 1 to 5 were prepared by uniformly mixing component A and component B in accordance with the composition and mass ratios shown in Tables 1-1 to 1-3.

TABLE 1-1

Compositions of Examples 1-8 and Comparative Examples 1-3

| Examples | Component A | Component B | A:B (mass ratio) |
|---|---|---|---|
| Example 1 | Monoisooctyl maleate | Linoleic acid | 7:3 |
| Comparative example 1 | Diisooctyl maleate | Linoleic acid | 7:3 |
| Example 2 | Monoisooctyl maleate | Unsaturated fatty acid glyceride JC-2017Z | 5:5 |
| Comparative Example 2 | Diisooctyl maleate | Unsaturated fatty acid glyceride JC-2017Z | 5:5 |
| Comparative Example 3 | Monoisooctyl dodecenyl succinate (Preparation Example 5) | Unsaturated fatty acid glyceride JC-2017Z | 5:5 |
| Example 3 | Monoisooctyl itaconate (Preparation Example 7) | Unsaturated fatty acid glyceride JC-2017Z | 7:3 |
| Example 4 | Methyltetrahydrophthalic acid monoester-substituted methyl ricinoleate (Preparation Example 9) | Unsaturated fatty acid glyceride JC-2017Z | 7:3 |
| Example 5 | Monoisooctyl maleate | Unsaturated fatty acid glyceride JC-2017Z | 7:3 |
| Example 6 | Monoisooctyl maleate | Unsaturated fatty acid glyceride JC-2017Z | 4:6 |
| Example 7 | Monoisooctyl maleate | Unsaturated fatty acid glyceride JC-2017Z | 2:8 |
| Example 8 | Monoisooctyl maleate | Unsaturated fatty acid glyceride JC-2017Z | 9:1 |

In Table 1-1, Examples 1-2 and Comparative Examples 1-3 are provided to illustrate the performance improvement of the lubricity improver compositions of the present application over non-inventive lubricity improver compositions; Examples 3-5 are provided to illustrate the impact of the selection of component A on the performance of lubricity improver compositions of the present application when component B used is a polyol ester of long-chain fatty acid; Examples 5-8 are provided to illustrate the impact of the selection of the mass ratio of component A/B on the performance of lubricity improver compositions of the present application when component B used is a polyol ester of long-chain fatty acid.

TABLE 1-2

Compositions of Examples 9-21 and Comparative Examples 4-5

| Examples | Component A | Component B | A:B (mass ratio) |
|---|---|---|---|
| Example 9 | Monoisooctyl succinate (Preparation Example 2) | Unsaturated fatty acid KMJ-031 | 4:6 |
| Example 10 | Mono-tert-butyl malonate | Unsaturated fatty acid KMJ-031 | 4:6 |
| Example 11 | Monobenzyl maleate (Preparation Example 8) | Unsaturated fatty acid KMJ-031 | 4:6 |
| Example 12 | Methyltetrahydrophthalic acid monoester-substituted methyl ricinoleate (Preparation Example 9) | Unsaturated fatty acid KMJ-031 | 3:7 |
| Example 13 | Maleic acid monoester-substituted methyl ricinoleate (Preparation Example 6) | Unsaturated fatty acid KMJ-031 | 3:7 |
| Example 14 | Monoisooctyl maleate | Unsaturated fatty acid KMJ-031 | 3:7 |

TABLE 1-2-continued

Compositions of Examples 9-21 and Comparative Examples 4-5

| Examples | Component A | Component B | A:B (mass ratio) |
|---|---|---|---|
| Example 15 | Monoisooctyl maleate | Unsaturated fatty acid KMJ-031 | 1:9 |
| Example 16 | Monoisooctyl maleate | Unsaturated fatty acid KMJ-031 | 2:8 |
| Example 17 | Monoisooctyl maleate | Unsaturated fatty acid KMJ-031 | 4:6 |
| Example 18 | Monoisooctyl maleate | Unsaturated fatty acid KMJ-031 | 5:5 |
| Example 19 | Monoisooctyl maleate | Unsaturated fatty acid KMJ-031 | 6:4 |
| Example 20 | Monoisooctyl maleate | Unsaturated fatty acid KMJ-031 | 7:3 |
| Example 21 | Monoisooctyl maleate | Unsaturated fatty acid KMJ-031 | 9:1 |
| Comparative Example 4 | Monoisooctyl maleate | Unsaturated fatty acid KMJ-031 | 9.5:0.5 |
| Comparative Example 5 | Monoisooctyl maleate | Unsaturated fatty acid KMJ-031 | 0.5:9.5 |

In Table 1-2, Examples 9-14 are provided to illustrate the impact of the selection of component A on the performance of lubricity improver compositions of the present application when component B used is a long-chain fatty acid; Examples 14-21 and Comparative Examples 4-5 are provided to illustrate the impact of the selection of the mass ratio of component A/B on the performance of the resulting lubricity improver composition when component B used is a long-chain fatty acid.

TABLE 1-3

Compositions of Examples 22-32

| Examples | Component A | Component B | A:B (mass ratio) |
|---|---|---|---|
| Example 22 | Monoisooctyl citraconate (Preparation Example 4) | Unsaturated fatty acid KMJ-031 | 6.5:3.5 |
| Example 23 | Mixture of maleic acid monoester-substituted methyl ricinoleate (Preparation Example 6) and monoisooctyl maleate in a mass ratio of 5:5 | Unsaturated fatty acid KMJ-031 | 7:3 |
| Example 24 | Monoisooctyl methyl tetrahydrophthalate (Preparation Example 3) | Tall oil fatty acid 2LT | 9:1 |
| Example 25 | Mixture of monoisooctyl maleate and maleic acid monoester-substituted methyl ricinoleate (Preparation Example 6) in a mass ratio of 5:5 | Tall oil fatty acid 2LT | 5:5 |
| Example 26 | Mixture of monoisooctyl maleate and maleic acid monoester-substituted methyl ricinoleate (Preparation Example 6) in a mass ratio of 4:6 | Tall oil fatty acid 2LT | 6:4 |
| Example 27 | Monoisononyl maleate (Preparation Example 1) | Tall oil fatty acid 2LT | 6:4 |
| Example 28 | Monoisononyl maleate (Preparation Example 1) | Unsaturated fatty acid JC-2006S | 5:5 |

TABLE 1-3-continued

Compositions of Examples 22-32

| Examples | Component A | Component B | A:B (mass ratio) |
|---|---|---|---|
| Example 29 | Mono-tert-butyl malonate | Unsaturated fatty acid JC-2006S | 7.5:2.5 |
| Example 30 | Mono-n-butyl maleate | Unsaturated fatty acid JC-2006S | 7:3 |
| Example 31 | Mono-n-butyl maleate | Oleic acid | 8:2 |
| Example 32 | Monohexyl phthalate | Unsaturated fatty acid R90 | 3:7 |

In Table 1-3, Examples 22 to 32 are provided to illustrate the performance of other lubricity improver compositions of the present application obtained by mixing component A and component B.

Detailed information of commercially available component A used in Examples 1-32 is as follows:

Monoisooctyl maleate: available from TCI Shanghai Chemical Industry Development Co., Ltd., with a purity of 95%;

Diisooctyl maleate: available from Beijing Yinokai Technology Co., Ltd., with a purity of 95%;

Mono-tert-butyl malonate: available from Ark Pharm Corporation, with a purity greater than 97%;

Mono-n-butyl maleate: available from Hubei Jusheng Technology Co., Ltd., with a purity of 99%; and Monohexyl phthalate: available from Shanghai Aladdin Biochemical Technology Co., Ltd., with a purity of 98%.

Among the component A used in Examples 1-32, compounds of formula (I-1) include mono-n-butyl maleate (e.g., Example 30), monoisononyl maleate (e.g., Example 27), monoisooctyl citraconate (e.g., Example 22) and the like; compounds of formula (I-2) include mono-tert-butyl malonate (e.g., Example 29) and the like; compounds of formula (I-3) include monohexyl phthalate (e.g., Example 32), monoisooctyl methyltetrahydrophthalate (e.g., Example 24) and the like; compounds of formula (I-4) include maleic acid monoester-substituted methyl ricinoleate (e.g., Example 13) and the like.

Detailed information of commercially available component B used in Examples 1-32 is as follows:

Linoleic acid: available from Shanghai Aladdin Biochemical Technology Co., Ltd., with a purity of 95%;

Oleic acid: available from Shanghai Aladdin Biochemical Technology Co., Ltd., with a purity of analytical grade;

Tall oil fatty acid 2LT: a fatty acid mixture obtained by purifying tall oil and mainly comprising unsaturated fatty acids such as linoleic acid and oleic acid, available from Arizonal Corporation, USA;

Unsaturated fatty acids KMJ-031, JC-2006S and R90: mainly comprise linoleic acid and oleic acid, and their detailed information is shown in Table 2;

Unsaturated fatty acid glyceride JC-2017Z: mainly comprises monoglycerides and diglycerides obtained by esterification of linoleic acid and oleic acid with glycerol, and its detailed information is shown in Table 2.

TABLE 2

Basic information of commercially available fatty acid and fatty acid ester products used in the examples and comparative examples

| | Type of product | | | |
|---|---|---|---|---|
| | Fatty acid product | | | Fatty acid ester product |
| Product name | KMJ-031 | JC-2006S | R90 | JC-2017Z |
| Manufacturer | Xinjiang Dasen Chemical Co., Ltd. | Jiangsu Chuangxin Petrochemical Co., Ltd. | Jiangxi Xilinke Co., Ltd. | Jiangsu Chuangxin Petrochemical Co., Ltd. |
| Total acid value, mgKOH/g | 199 | 198 | 197 | 0.48 |
| Oleic acid content (mass fraction), % | 29.91 | 32.87 | 32.36 | 30.12 |
| Linoleic acid content (mass fraction), % | 59.82 | 52.57 | 57.56 | 53.65 |
| Saturated fatty acid content (mass fraction), % | 1.9 | 1.59 | 1.11 | 1.93 |
| Sulfur content, mg/kg | 53 | 32 | 32 | 25 |
| Water content, % (w) | Trace | Trace | 0.03 | Trace |
| Closed-cup flash point, ° C. | >150.0 | >150.0 | >150.0 | >150.0 |
| Freezing point, ° C. | −16 | −12 | −20 | −18 |
| Na, mg/kg | <1 | <1 | 2.2 | <1 |
| Ca, mg/kg | <1 | <1 | <1 | <1 |
| Mg, mg/kg | <1 | <1 | <1 | <1 |
| Zn, mg/kg | <1 | <1 | <1 | <1 |
| K, mg/kg | <1 | <1 | <1 | <1 |
| Density at 20° C., kg/m$^3$ | 901.3 | 904.0 | 887.6 | 952.3 |
| Viscosity at 40° C., mm$^2$/s | 17.75 | 16.59 | 18.13 | 57.98 |
| Free glycerol content (mass fraction), % | — | — | — | 0.46 |
| Cloud point, ° C. | −16 | −13 | −13 | — |

Test Examples

The lubricity improver compositions of Examples 1 to 32 and Comparative Examples 1 to 5 were mixed with diesel fuel, respectively, and the effects of their use in diesel fuel were tested. The low-sulfur Diesel fuel A is available from Sinopec Yanshan petrochemical company, the ultra-low-sulfur Diesel fuel B is from Sinopec Shanghai Gaoqiao petrochemical Co., Ltd., and the physicochemical properties of the Diesel fuel A and the Diesel fuel B are shown in Table 3.

TABLE 3

Physicochemical properties of diesel fuel used for testing

| Item | Diesel fuel A | Diesel fuel B |
|---|---|---|
| Density (20° C.)/(kg · m$^{-3}$) | 834.1 | 806.2 |
| Initial boiling point/° C. | 192.0 | 210.1 |
| 5% temperature/° C. | 216.8 | 226.3 |
| 10% temperature/° C. | 227.5 | 231.3 |
| 20% temperature/° C. | 240.0 | 236.4 |
| 30% temperature/° C. | 251.2 | 242.1 |
| 40% temperature/° C. | 258.9 | 246.6 |
| 50% temperature/° C. | 269.0 | 250.3 |
| 60% temperature/° C. | 278.8 | 254.3 |
| 70% temperature/° C. | 291.2 | 258.3 |

TABLE 3-continued

Physicochemical properties of diesel fuel used for testing

| Item | Diesel fuel A | Diesel fuel B |
|---|---|---|
| 80% temperature/° C. | 305.1 | 263.3 |
| 90% temperature/° C. | 325.6 | 273.6 |
| 95% temperature/° C. | 341.5 | 290.3 |
| End boiling point/° C. | 345.8 | 305.7 |
| Residual amount (Ψ)/% | 1.0 | 1.0 |
| Loss amount (Ψ)/% | 1.4 | 1.3 |
| Acidity/(mgKOH · 100 mL$^{-1}$) | 0.45 | 0.51 |
| Viscosity at 20° C./(mm$^2$ · s$^{-1}$) | 4.512 | 3.421 |
| Viscosity at 40° C./(mm$^2$ · s$^{-1}$) | 2.913 | 2.290 |
| 10% carbon residue, % | <0.05 | <0.05 |
| Ash content, % | <0.002 | <0.002 |
| Cold filter plugging point/° C. | −5 | −29 |
| Freezing Point/° C. | −10 | −36 |
| Closed-cup flash point/° C. | 73 | 82 |
| w (sulfur)/mg · L$^{-1}$ | 10 | <5 |
| Water content, % | Trace | Trace |
| Lubricity (HFRR)/μm | 564 | 651 |

The lubricity of diesel fuel was evaluated by measuring the wear scar diameter (WSD) at 60° C. on a High-Frequency Reciprocating Rig (HFRR, PCS instruments, UK) according to the SH/T 0765 method, and the influence of temperature and humidity was corrected to obtain the reported wear scar diameter result WS 1.4.

The wear scar diameter WS1.4 values of the diesel fuel before and after addition of the lubricity improver composition are shown in Tables 4-1, 4-2, 5-1, 5-2, 5-3 and 5-4, where the smaller the wear scar diameter the better the lubricity of the diesel fuel. At present, most diesel fuel standards in the world such as European standard EN 590, Chinese national standard GB 19147 for automotive diesel fuels and Beijing local standard DB 11/239 automotive diesel fuels use a standard of wear scar diameter of less than 460 μm (60° C.) as the criterion of acceptability for the lubricity of diesel fuel.

TABLE 4-1

Test results for the compositions of Example 1 and Comparative Example 1 in diesel fuel A

| Oil sample | Amount added ($mg \cdot kg^{-1}$) | WS1.4 (μm) |
|---|---|---|
| Diesel fuel A | / | 564 |
| Diesel fuel A + monoisooctyl maleate | 70 | 399 |
| Diesel fuel A + monoisooctyl maleate | 100 | 324 |
| Diesel fuel A + linoleic acid | 30 | 525 |
| Diesel fuel A + linoleic acid | 100 | 458 |
| Diesel fuel A + product of Example 1 | 100 | 226 |
| Diesel fuel A + product of Example 1 | 70 | 305 |
| Diesel fuel A + product of Comparative Example 1 | 100 | 524 |

Figure 2:
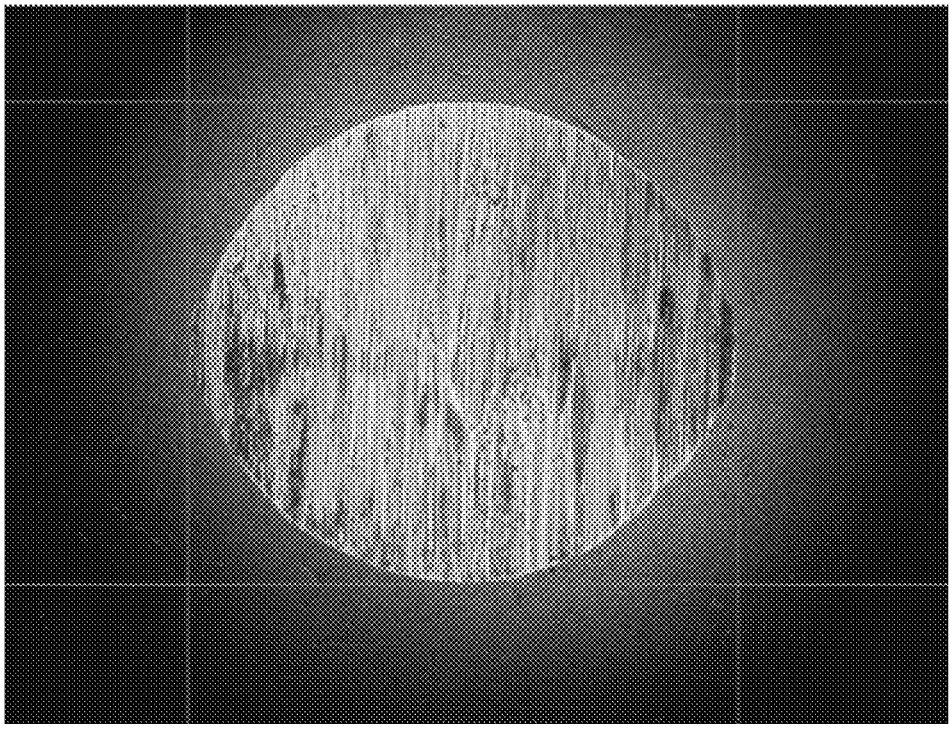
FIG. 2 shows a photograph of the wear scar of Diesel fuel A used in the examples.
Figure 3:
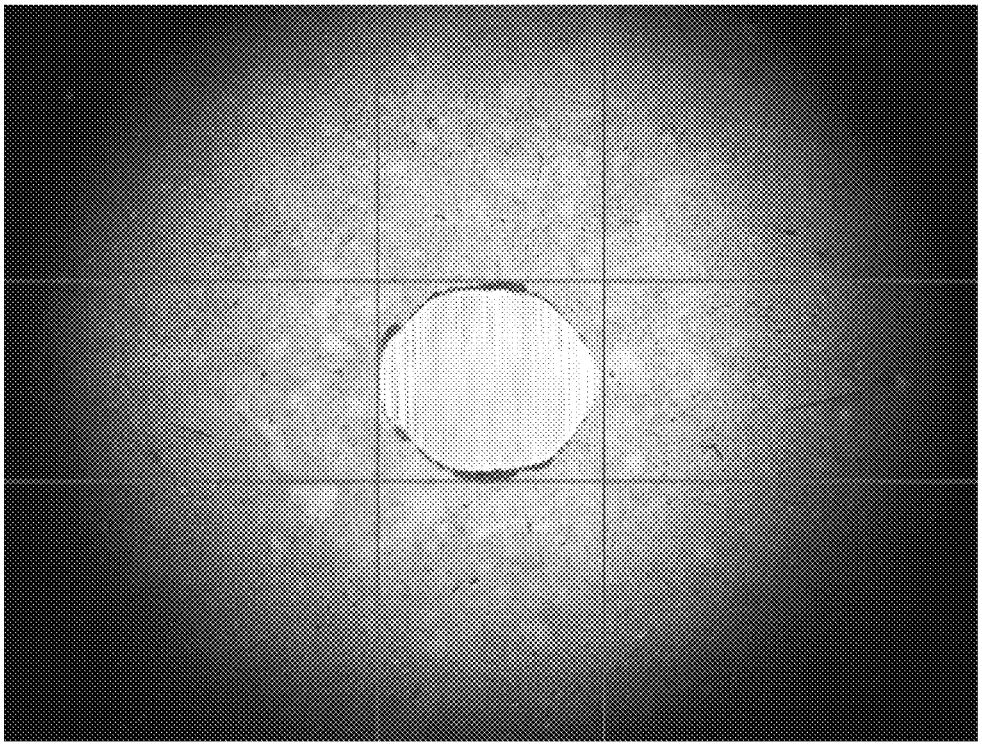
FIG. 3 shows a photograph of the wear scar of Diesel fuel A to which a composition obtained in Example 1 has been added at an amount of 100 mg/kg, WS1.4=226 μm.
Figure 4:
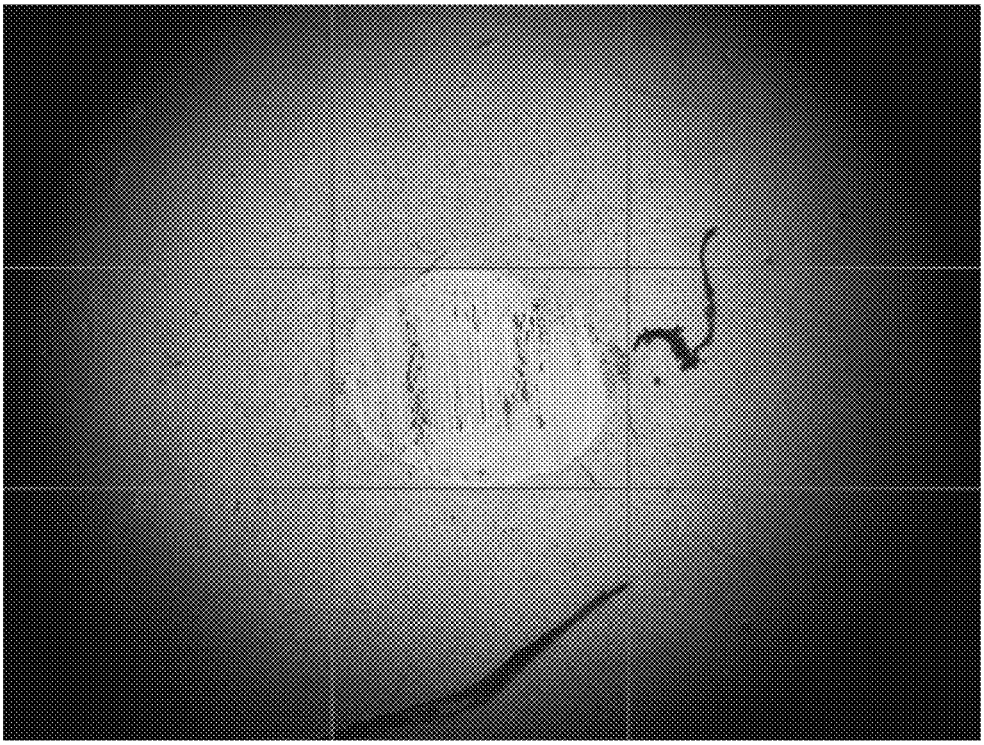
FIG. 4 shows a photograph of the wear scar of Diesel fuel A to which the composition obtained in Example 1 has been added at an amount of 70 mg/kg, WS1.4=305 μm.

As can be seen from the results listed in label 4-1, the initial Diesel fuel A has a wear scar diameter WS1.4 of 564 μm (see FIG. 2 for the photograph of the wear scar), and does not satisfy the requirements on performance of automobile diesel fuels. The wear scar diameter WS1.4 of Diesel fuel A can be reduced from 564 μm to 324 μm by using 100 mg/kg of monoisooctyl maleate alone, reduced from 564 μm to 458 μm by using 100 mg/kg of linoleic acid alone, and surprisingly reduced from 564 μm to 226 μm by using 100 mg/kg of the composition obtained in Example 1 by mixing monoisooctyl maleate with linoleic acid in a mass ratio of 7:3 (see FIG. 3 for the photograph of the wear scar). Furthermore, even if the amount of the composition obtained in Example 1 was reduced to 70 mg/kg, the wear scar diameter WS1.4 of the Diesel fuel A can still be reduced from 564 μm to 305 μm (see FIG. 4 for the photograph of the wear scar). The above results clearly show that the lubricity improver compositions of the present application show a significant synergistic effect between component A and component B, so that the lubricity improving effect of the compositions is significantly superior over that of component A and component B alone, and thus the amount of the lubricity improver used can be greatly reduced. In contrast, the composition of Comparative Example 1 obtained by mixing diisooctyl maleate with linoleic acid in the same mass ratio shows a poor lubricity improving effect and does not show any synergistic effect.

TABLE 4-2

Test results for compositions of Example 2 and Comparative Examples 2-3 in Diesel fuel A

| Oil sample | Amount added ($mg \cdot kg^{-1}$) | WS1.4 (μm) |
|---|---|---|
| Diesel fuel A | / | 564 |
| Diesel fuel A + monoisooctyl maleate | 50 | 437 |
| Diesel fuel A + diisooctyl maleate | 100 | 561 |

TABLE 4-2-continued

Test results for compositions of Example 2 and Comparative Examples 2-3 in Diesel fuel A

| Oil sample | Amount added ($mg \cdot kg^{-1}$) | WS1.4 (μm) |
|---|---|---|
| Diesel fuel A + unsaturated fatty acid glyceride JC-2017Z | 50 | 521 |
| Diesel fuel A + unsaturated fatty acid glyceride JC-2017Z | 100 | 469 |
| Diesel fuel A + product of Example 2 | 100 | 212 |
| Diesel fuel A + product of Example 2 | 50 | 415 |
| Diesel fuel A + product of Comparative Example 2 | 100 | 456 |
| Diesel fuel A + product of Comparative Example 2 | 50 | 522 |
| Diesel fuel A + product of Comparative Example 3 | 100 | 429 |
| Diesel fuel A + product of Comparative Example 3 | 50 | 503 |

As can be seen from the results listed in Table 4-2, the initial Diesel fuel A shows a wear scar diameter WS1.4 of 564 μm, after adding thereto 100 mg/kg of diisooctyl maleate alone, the modified diesel fuel shows a WS1.4 value of 561 μm, indicating no lubricity improving effect; after adding thereto 100 mg/kg of monoisooctyl maleate alone, the modified diesel fuel shows a WS1.4 value of 324 μm (as shown in Table 4-1); while after adding thereto 100 mg/kg unsaturated fatty acid glyceride JC-2017Z alone, the modified diesel fuel shows a WS1.4 value of 469 μm, which still does not meet the requirements on performance. However, the composition obtained in Example 2 by mixing monoisooctyl maleate with unsaturated fatty acid glyceride JC-2017Z in the mass ratio of 5:5 can reduce the WS1.4 value of the modified diesel fuel to 212 μm when added in an amount of 100 mg/kg, showing a surprising lubricity improving effect, and can reduce the WS1.4 value of the modified diesel fuel to 415 μm even when added in an amount of 50 mg/kg, still satisfying the requirements on performance. In contrast, the lubricity improving effect of the composition obtained in Comparative Example 2 using diisooctyl maleate and the composition obtained in Comparative Example 3 using monoisooctyl dodecenyl succinate is significantly lower than that of the composition of Example 2.

TABLE 5-1

Test results for compositions of Example 1 and Comparative Example 1 in Diesel fuel B

| Oil sample | Amount added ($mg \cdot kg^{-1}$) | WS1.4 (μm) |
|---|---|---|
| Diesel fuel B | / | 651 |
| Diesel fuel B + monoisooctyl maleate | 200 | 233 |
| Diesel fuel B + monoisooctyl maleate | 100 | 466 |
| Diesel fuel B + linoleic acid | 100 | 513 |
| Diesel fuel B + linoleic acid | 200 | 413 |
| Diesel fuel B + product of Example 1 | 200 | 189 |
| Diesel fuel B + product of Example 1 | 100 | 256 |
| Diesel fuel B + product of Comparative Example 1 | 200 | 584 |

Figure 5:
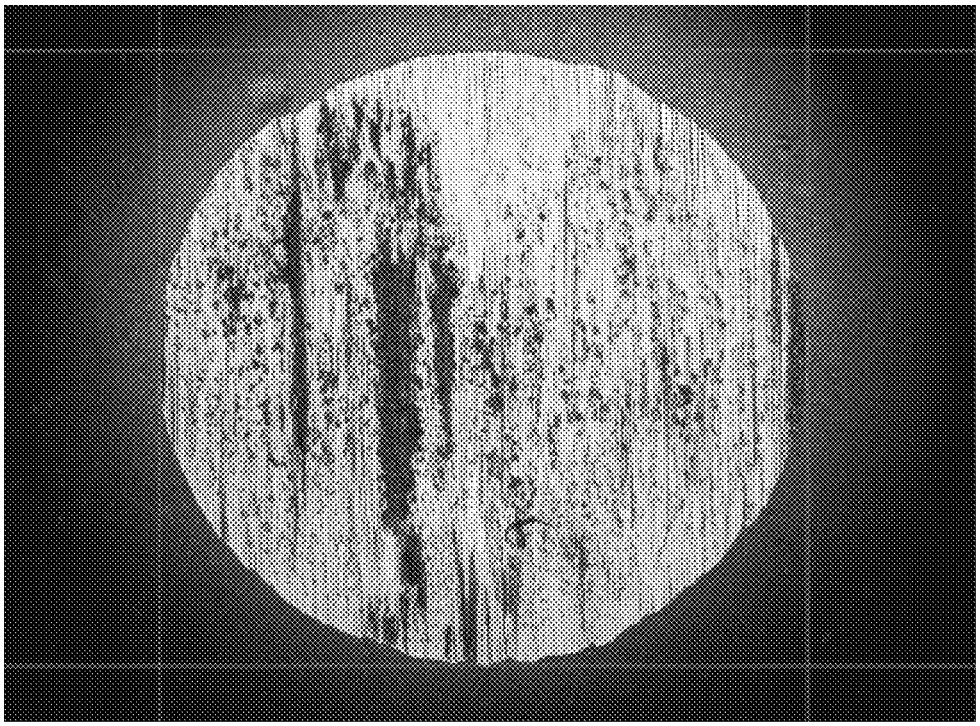
FIG. 5 shows a photograph of the wear scar of Diesel fuel B used in the examples.
Figure 6:
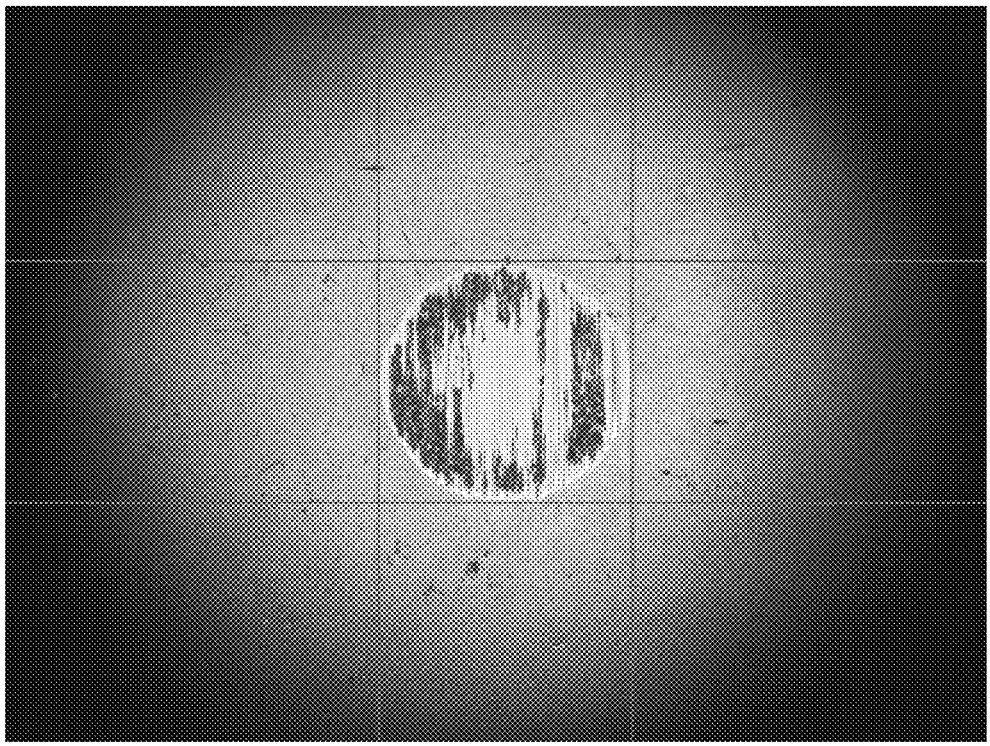
FIG. 6 shows a photograph of the wear scar of Diesel fuel B to which the composition obtained in Example 1 has been added at an amount of 100 mg/kg, WS1.4=256 μm.
Figure 7:
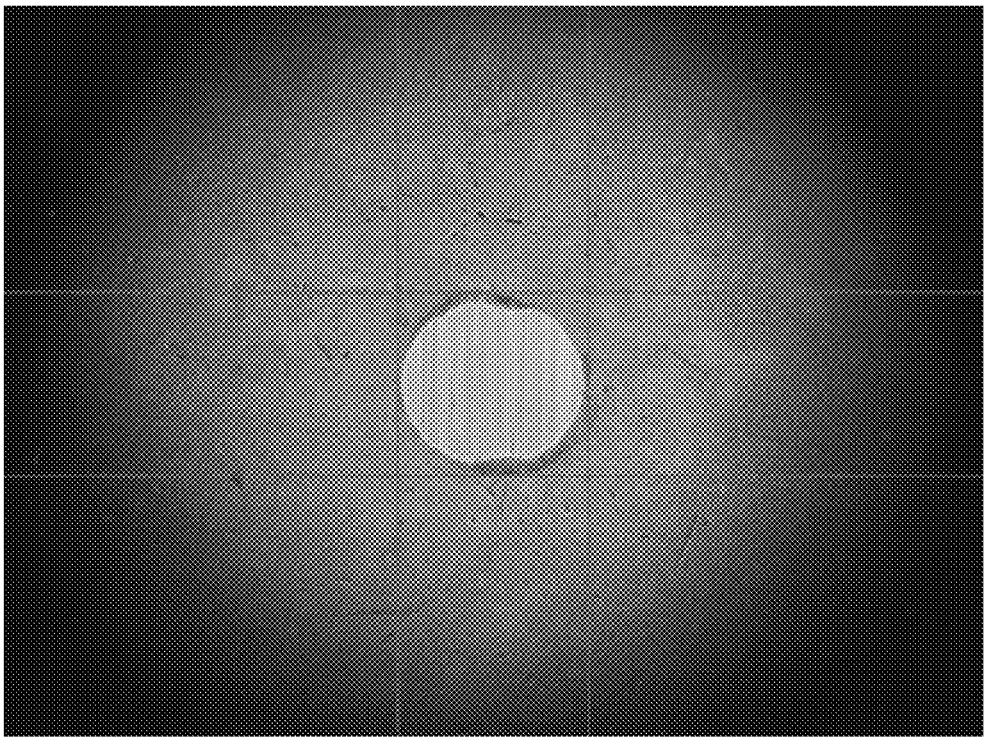
FIG. 7 shows a photograph of the wear scar of Diesel fuel B to which the composition obtained in Example 1 has been added at an amount of 200 mg/kg, WS1.4=189 μm.

As can be seen from the results listed in Table 5-1, the wear scar diameter WS1.4 of the initial Diesel fuel B is 651 μm (see FIG. 5 for the photograph of the wear scar diameter), which does not satisfy the requirements on performance of automotive diesel fuels. After adding 100 mg/kg of monoisooctyl maleate alone, the WS1.4 value of the modified diesel fuel is 466 μm, which still does not meet the requirements on performance; after adding 100 mg/kg of linoleic acid alone, the WS1.4 value of the modified diesel fuel is 513 μm. When the composition obtained in Example 1 of the present application is added into the diesel fuel at an amount of 100 mg/kg, the WS1.4 value of the modified diesel fuel is reduced to 256 μm (see FIG. 6 for the photograph of the wear scar), and when the composition is added into the diesel fuel at an amount of 200 mg/kg, the WS1.4 value of the modified diesel fuel is reduced to 189 μm (see FIG. 7 for the photograph of the wear scar), and the lubricity of the modified diesel fuel is obviously improved. This effect is surprising and indicates that there is a significant synergistic effect between monoisooctyl maleate and linoleic acid in the composition obtained in Example 1. In contrast, the composition obtained in Comparative Example 1 by mixing diisooctyl maleate with linoleic acid in the same mass ratio shows a poor lubricity improving effect and does not show any synergistic effect.

TABLE 5-2

Test results for compositions of Examples 2-8 and Comparative Examples 2-3 in Diesel fuel B

| Oil sample | Amount added (mg · kg$^{-1}$) | WS1.4 (μm) |
|---|---|---|
| Diesel fuel B | / | 651 |
| Diesel fuel B + monoisooctyl maleate | 100 | 412 |
| Diesel fuel B + unsaturated fatty acid glyceride JC-2017Z | 200 | 361 |
| Diesel fuel B + unsaturated fatty acid glyceride JC-2017Z | 100 | 459 |
| Diesel fuel B + product of Example 2 | 200 | 191 |
| Diesel fuel B + product of Example 2 | 100 | 305 |
| Diesel fuel B + product of Example 2 | 75 | 391 |
| Diesel fuel B + product of Comparative Example 2 | 200 | 452 |
| Diesel fuel B + product of Comparative Example 2 | 100 | 591 |
| Diesel fuel B + product of Comparative Example 3 | 200 | 437 |
| Diesel fuel B + product of Comparative Example 3 | 100 | 579 |
| Diesel fuel B + monoisooctyl itaconate (Preparation Example 7) | 100 | 435 |
| Diesel fuel B + product of Example 3 | 100 | 363 |
| Diesel fuel B + product of Example 4 | 100 | 356 |
| Diesel fuel B + product of Example 5 | 100 | 349 |
| Diesel fuel B + product of Example 6 | 100 | 256 |
| Diesel fuel B + product of Example 7 | 100 | 355 |
| Diesel fuel B + product of Example 8 | 100 | 363 |

As can be seen from the results of Table 5-2:

1) when 100 mg/kg of monoisooctyl maleate is added into the Diesel fuel B alone, the WS1.4 value of the modified diesel fuel is 412 μm; when 100 mg/kg of unsaturated fatty acid glyceride JC-2017Z is added into the Diesel fuel B alone, the WS1.4 value of the modified diesel fuel is 459 μm; while when 100 mg/kg of the composition of Example 2 is added to the Diesel fuel B, the wear scar diameter WS1.4 of the Diesel fuel B is surprisingly reduced to 305 μm, indicating that the monoisooctyl maleate and the unsaturated fatty acid glyceride JC-2017Z present in the composition of Example 2 show a remarkable synergistic effect. In contrast, the compositions obtained in Comparative Example 2 using diisooctyl maleate and the composition obtained in Comparative Example 3 using monoisooctyl dodecenyl succinate show a lubricity improving effect significantly poorer than that of the composition of Example 2, even poorer than component B alone, indicating that there is no synergistic effect between the components in the compositions of Comparative Examples 2-3;
2) Within the range of the mass ratio of component A/B described in the present application, the compositions of all examples show excellent lubricity improving effect;
3) When component B is a polyol ester of long-chain fatty acid, the composition of Example 5 using monoisooctyl maleate provides better lubricity improving effect than the composition of Example 3 using monoisooctyl itaconate and the composition of Example 4 using phthalate monoester-substituted methyl ricinoleate, with the same amount, the same component B and the same mass ratio of component A/B being used; and
4) The composition of Example 6 having a mass ratio of component A/B of 4:6 provides a significantly better lubricity improving effect than the composition of Example 5 and the composition of Example 8 having a greater mass ratio of component A/B and the composition of Example 7 having a smaller mass ratio of component A/B, with the same component A, the same component B, and the same amount being used.

TABLE 5-3

5-3 Test results for compositions of Examples 9-21 and Comparative Examples 4-5 in Diesel fuel B

| Oil sample | Amount added (mg · kg$^{-1}$) | WS1.4 (μm) |
|---|---|---|
| Diesel fuel B | / | 651 |
| Diesel fuel B + unsaturated fatty acid KMJ-031 | 70 | 598 |
| Diesel fuel B + unsaturated fatty acid KMJ-031 | 100 | 536 |
| Diesel fuel B + unsaturated fatty acid KMJ-031 | 120 | 497 |
| Diesel fuel B + unsaturated fatty acid KMJ-031 Diesel fuel B + monoisooctyl succinate (Preparation Example 2) | 200 | 408 |
| Diesel fuel B + monoisooctyl succinate (Preparation Example 2) | 200 | 269 |
| Diesel fuel B + product of Example 9 | 80 | 451 |
| Diesel fuel B + mono-tert-butyl malonate | 100 | 275 |
| Diesel fuel B + mono-tert-butyl malonate | 200 | 272 |
| Diesel fuel B + product of Example 10 | 120 | 453 |
| Diesel fuel B + product of Example 10 | 200 | 201 |
| Diesel fuel B + product of Example 11 | 120 | 304 |
| Diesel fuel B + methyltetrahydrophthalic acid monoester-substituted methyl ricinoleate (Preparation Example 9) | 100 | 334 |
| Diesel fuel B + product of Example 12 | 100 | 418 |
| Diesel fuel B + product of Example 13 | 100 | 370 |
| Diesel fuel B + monoisooctyl maleate | 100 | 346 |
| Diesel fuel B + product of Example 14 | 100 | 412 |
| Diesel fuel B + product of Example 14 | 100 | 313 |
| Diesel fuel B + monoisooctyl maleate | 120 | 285 |
| Diesel fuel B + product of Example 15 | 12 | 643 |
| Diesel fuel B + monoisooctyl maleate | 120 | 398 |
| Diesel fuel B + product of Example 16 | 24 | 601 |
| Diesel fuel B + product of Example 17 | 120 | 367 |
| Diesel fuel B + product of Example 18 | 120 | 268 |
| Diesel fuel B + product of Example 18 | 100 | 332 |
| Diesel fuel B + product of Example 18 | 120 | 259 |
| Diesel fuel B + product of Example 19 | 150 | 197 |
| Diesel fuel B + product of Example 20 | 120 | 208 |
| Diesel fuel B + product of Example 21 | 100 | 257 |
| Diesel fuel B + product of Comparative Example 4 | 100 | 260 |
| | 100 | 486 |

TABLE 5-3-continued 5-3 Test results for compositions of Examples 9-21 and Comparative Examples 4-5 in Diesel fuel B

| Oil sample | Amount added (mg · kg$^{-1}$) | WS1.4 (μm) |
|---|---|---|
| Diesel fuel B + product of Comparative Example 5 | 100 | 548 |
| Diesel fuel B + product of Comparative Example 5 | 120 | 473 |

As can be seen from the results of Table 5-3:

1) When component B is a long-chain fatty acid, the composition of Example 9 using monoisooctyl succinate provides better lubricity improving effect than the composition of Example 11 using monobenzyl maleate; the composition obtained in Example 17 using monoisooctyl maleate provides better lubricity improving effect than the composition of Example 10 using mono-tert-butyl malonate; the composition of Example 14 using monoisooctyl maleate provides a lubricity improving effect better than the composition of Example 13 using maleic acid monoester-substituted methyl ricinoleate and further better than the composition of Example 12 using methyltetrahydrophthalate monoester-substituted methyl ricinoleate, with the same amount, the same component B and the same mass ratio of component A/B being used;
2) Within the range of the mass ratio of component A/B described in the present application, the compositions of all examples show excellent lubricity improving effect, and the composition of Comparative Example 4 having a component A/B mass ratio of 9.5:0.5 and the composition of Comparative Example 5 having a component A/B mass ratio of 0.5:9.5 show significantly lower lubricity improving effect than the compositions of Examples 9 to 21, even lower than component A alone, indicating that there is no synergistic effect between the components in the compositions of Comparative Examples 4 to 6;
3) When component B is a long-chain fatty acid, with the same component A and the same component B being used, the addition of a composition having a component A/B mass ratio of 1:9 (e.g., Example 15) in a total amount of 120 mg/kg (comprising 12 mg/kg of component A) can reduce the wear scar diameter of the diesel fuel to 398 μm, while the addition of 12 mg/kg of component A alone shows almost no anti-wear effect (643 μm); the addition of a composition having a component A/B mass ratio of 2:8 (e.g., Example 16) in a total amount of 120 mg/kg (comprising 24 mg/kg of component A) can reduce the wear scar diameter of the diesel fuel to 367 μm, while the addition of 24 mg/kg of component A alone shows a poor anti-wear effect (601 μm) and the addition of 120 mg/kg of component B alone also shows a poor anti-wear effect (497 μm), indicating that component A and component B have a synergistic effect. With the same amount used, the composition of Example 20 having a component A/B mass ratio of 7:3 provides better lubricity improving effect than the composition of Example 21 having a greater component A/B mass ratio, and compositions of Example 18 and Example 14 having a smaller component A/B mass ratio; and, the composition of Example 19 having a component A/B mass ratio of 6:4 provides a better lubricity improving effect than the composition of Example 17 having a component A/B mass ratio of 4:6.

TABLE 5-4

Test results for compositions of Examples 22-32 in Diesel fuel B

| Oil sample | Amount added (mg · kg$^{-1}$) | WS1.4 (μm) |
|---|---|---|
| Diesel fuel B | / | 651 |
| Diesel fuel B + unsaturated fatty acid KMJ-031 | 200 | 408 |
| Diesel fuel B + unsaturated fatty acid KMJ-031 | 120 | 497 |
| Diesel fuel B + monoisooctyl citraconate (Preparation Example 4) | 200 | 365 |
| Diesel fuel B + monoisooctyl citraconate (Preparation Example 4) | 130 | 421 |
| Diesel fuel B + product of Example 22 | 200 | 307 |
| Diesel fuel B + product of Example 22 | 120 | 342 |
| Diesel fuel B + monoisononyl maleate (Preparation Example 1) | 200 | 233 |
| Diesel fuel B + monoisononyl maleate (Preparation Example 1) | 120 | 338 |
| Diesel fuel B + monoisononyl maleate (Preparation Example 1) | 100 | 402 |
| Diesel fuel B + product of Example 23 | 100 | 321 |
| Diesel fuel B + tall oil fatty acid 2LT | 80 | 518 |
| Diesel fuel B + tall oil fatty acid 2LT | 200 | 417 |
| Diesel fuel B + tall oil fatty acid 2LT | 20 | 632 |
| Diesel fuel B + monoisooctyl methyl tetrahydrophthalate (Preparation Example 3) | 200 | 314 |
| Diesel fuel B + monoisooctyl methyl tetrahydrophthalate (Preparation Example 3) | 180 | 365 |
| Diesel fuel B + product of Example 24 | 200 | 260 |
| Diesel fuel B + product of Example 24 | 120 | 389 |
| Diesel fuel B + product of Example 25 | 96 | 377 |
| Diesel fuel B + product of Example 26 | 100 | 355 |
| Diesel fuel B + product of Example 27 | 100 | 282 |
| Diesel fuel B + unsaturated fatty acid JC-2006S | 200 | 399 |
| Diesel fuel B + unsaturated fatty acid JC-2006S | 100 | 499 |
| Diesel fuel B + unsaturated fatty acid JC-2006S | 50 | 601 |
| Diesel fuel B + product of Example 28 | 200 | 190 |
| Diesel fuel B + product of Example 28 | 100 | 370 |
| Diesel fuel B + mono-tert-butyl malonate | 200 | 272 |
| Diesel fuel B + mono-tert-butyl malonate | 120 | 453 |
| Diesel fuel B + product of Example 29 | 200 | 255 |
| Diesel fuel B + product of Example 29 | 120 | 365 |
| Diesel fuel B + mono-n-butyl maleate | 200 | 312 |
| Diesel fuel B + mono-n-butyl maleate | 160 | 377 |
| Diesel fuel B + product of Example 30 | 200 | 249 |
| Diesel fuel B + oleic acid | 40 | 639 |
| Diesel fuel B + oleic acid | 200 | 431 |
| Diesel fuel B + product of Example 31 | 200 | 208 |
| Diesel fuel B + product of Example 31 | 120 | 330 |
| Diesel fuel B + monohexyl phthalate | 200 | 329 |
| Diesel fuel B + monohexyl phthalate | 60 | 518 |
| Diesel fuel B + unsaturated fatty acid R90 | 200 | 408 |
| Diesel fuel B + unsaturated fatty acid R90 | 140 | 489 |
| Diesel fuel B + product of Example 32 | 200 | 276 |
| Diesel fuel B + product of Example 32 | 140 | 359 |

From the results of Table 5-4, it can be seen that the lubricity improver compositions of the present application formulated with various components A and B all show excellent lubricity improving effect, which is significantly superior to those of component A and component B alone, and can greatly improve the lubricity of diesel fuel at a very small amount.

In conclusion, the test results show that in the lubricity improver composition of the present application, the component A and the component B show an obvious synergistic effect after mixing at a specific ratio, and an improving effect on the lubricity of diesel fuel significantly better than that of component A and component B alone, so that the amount to be added of the lubricity improver of the present application can be greatly reduced, the cost of additive required for the lubricity of the diesel fuel to meet the requirement on performance is reduced, and the risk of side effect caused by the addition of the additive is also reduced.

The present application is illustrated in detail hereinabove with reference to preferred embodiments, but is not intended to be limited to those embodiments. Various modifications may be made following the inventive concept of the present application, and these modifications shall be within the scope of the present application.

It should be noted that the various technical features described in the above embodiments may be combined in any suitable manner without contradiction, and in order to avoid unnecessary repetition, various possible combinations are not described in the present application, but such combinations shall also be within the scope of the present application.

In addition, the various embodiments of the present application can be arbitrarily combined as long as the combination does not depart from the spirit of the present application, and such combined embodiments should be considered as the disclosure of the present application.

The invention claimed is:

1. A lubricity improver composition for fuel oil, comprising a component A and a component B, wherein the component A is a dicarboxylic acid monoester of formula (I-1):

(I-1)

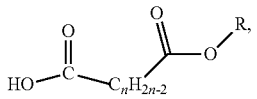

wherein n is an integer of 2 to 6, R is a $C_{3-20}$ hydrocarbyl group, and the component A is selected from maleic acid monoester, fumaric acid monoester, citraconic acid monoester, methyl fumaric acid monoester, 2,3-dimethyl maleic acid monoester, glutaconic acid monoester, and combinations thereof, or the component A is a dicarboxylic acid monoester of formula (I-2):

(I-2)

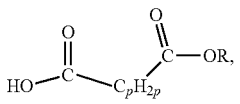

wherein p is an integer from 1 to 8, R is a $C_{3-20}$ hydrocarbyl group, and the component A is selected from malonic acid monoester, succinic acid monoester, glutaric acid monoester, adipic acid monoester, azelaic acid monoester, sebacic acid monoester, and combinations thereof, or the component A is a dicarboxylic acid monoester of formula (I-4):

(I-4)

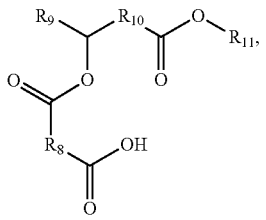

wherein $R_8$ is a $C_{2-10}$ divalent hydrocarbyl group; $R_9$ is hydrogen or a hydrocarbyl group, $R_{10}$ is a divalent hydrocarbyl group, and the total number of carbon atoms of $R_9$ and $R_{10}$ is 15-21, and the total number of carbon-carbon double bonds is 0-3; $R_{11}$ is hydrogen or a $C_{1-10}$ hydrocarbyl group; and the component B is selected from $C_{8-24}$ long-chain fatty acids, polyol esters thereof, and mixtures thereof, wherein a total amount of the component A and the component B is 70 wt % to 100 wt %, based on the total weight of the composition; and a mass ratio of the component A to the component B is 9:1 to 1:9.

2. The composition according to claim 1, wherein the component B is a $C_{8-24}$ long-chain fatty acid, and the mass ratio of the component A to the component B is from 8:2 to 2:8.

3. The composition according to claim 1, wherein the component B is a polyol ester of a $C_{8-24}$ long-chain fatty acid, and the mass ratio of the component A to the component B is from 8:2 to 1:9.

4. The composition according to claim 1, wherein the component B is a $C_{8-24}$ long-chain fatty acid, and the composition comprises 20-80 wt % of the component A, and 20-80 wt % of the component B, based on the weight of the composition.

5. The composition according to claim 1, wherein the component B is a polyol ester of a $C_{8-24}$ long-chain fatty acid, and the composition comprises 10-80 wt % of the component A, and 20-90 wt % of the component B, based on the weight of the composition.

6. The composition according to claim 1, wherein the dicarboxylic acid monoester of formula (I-1) is maleic acid monoester.

7. The composition according to claim 1, wherein the dicarboxylic acid monoester of formula (I-2) is selected from malonic acid monoester, succinic acid monoester, adipic acid monoester, and combinations thereof.

8. The composition according to claim 1, wherein in formula (I-4), $R_8$ is a $C_{2-10}$ divalent hydrocarbyl group, $R_9$ is hydrogen or a hydrocarbyl group, $R_{10}$ is a divalent hydrocarbyl group, and the total number of carbon atoms of $R_9$ and $R_{10}$ is 15-21, and the total number of carbon-carbon double bonds is 0-3, and $R_{11}$ is hydrogen or a $C_{1-10}$ hydrocarbyl group.

9. The composition according to claim 1, wherein the component A is selected from monobutyl maleate, monoisooctyl maleate, monoisononyl maleate, monoisooctyl citraconate, succinic acid monoester-substituted methyl ricinoleate, succinic acid monoester-substituted ricinoleic acid, maleic acid monoester-substituted methyl ricinoleate, maleic acid monoester-substituted ricinoleic acid, methyltetrahydrophthalic acid monoester-substituted methyl ricinoleate, and combinations thereof.

10. The composition according to claim 1, wherein component B is selected from $C_{12-20}$ unsaturated fatty acids or any combination thereof, the polyol is selected from ethylene glycol, glycerol, 1,2-propylene glycol, 1,3-propylene glycol, sorbitan, pentaerythritol, trimethylolpropane, and combinations thereof.

11. A method for improving the lubricity of diesel fuels, comprising adding to a low-sulfur diesel fuel the lubricity improver composition for fuel oil according to claim 1, wherein the lubricity improver composition for fuel oil is added in an amount of 10 to 400 ppm.

12. A diesel fuel composition, comprising a low-sulfur diesel fuel and a lubricity improver composition for fuel oil according to claim 1, wherein the lubricity improver composition for fuel oil is present in the diesel fuel composition in an amount of 10 to 400 ppm.

13. The composition according to claim 8, wherein in formula (I-4), $R_8$ is selected from ethylene, vinylene, methylene ethylene, methylethylene, butylene, methylbutylene, butenylene, phenyl, cyclohexyl, methylhexahydrophenyl, and methyltetrahydrophenyl, and $R_{11}$ is selected from hydrogen, methyl, and ethyl.

14. The composition according to claim 13, wherein the dicarboxylic acid monoester of formula (I-4) is selected from maleic acid monoester-substituted methyl ricinoleate, maleic acid monoester-substituted ricinoleic acid, succinic acid monoester-substituted methyl ricinoleate, succinic acid monoester-substituted ricinoleic acid, phthalic acid monoester-substituted methyl ricinoleate, methylhexahydrophthalic acid monoester-substituted methyl ricinoleate, methyltetrahydrophthalic acid monoester-substituted methyl ricinoleate, and combinations thereof.

15. The composition according to claim 10, wherein the component B is selected from oleic acid, linoleic acid, linolenic acid, ricinoleic acid, or anyand combinations thereof, or the component B is selected from mixtures of fatty acids comprising oleic acid, linoleic acid, linolenic acid, and ricinoleic acid, and the polyol is glycerol.

16. The lubricity improver composition for fuel oil according to claim 1, wherein the component A is of formula (I-1), wherein R is a $C_{4-18}$ hydrocarbyl group.

17. The lubricity improver composition for fuel oil according to claim 1, wherein the Component component A is a dicarboxylic acid monoester having theof formula (I-2), wherein R is a $C_{4-18}$ hydrocarbyl group.

18. The lubricity improver composition for fuel oil according to claim 1, wherein the component A is a dicarboxylic acid monoester having the of formula (I-4), wherein $R_{11}$ is hydrogen or a $C_{1-4}$ hydrocarbyl group.

19. The lubricity improver composition for fuel oil according to claim 1, wherein the total amount of component A and component B is 90 wt % to 100 wt %, based on the total weight of the composition.

20. The lubricity improver composition for fuel oil according to claim 1, wherein the total amount of component A and component B is 100 wt %, based on the total weight of the composition.

21. The lubricity improver composition for fuel oil according to claim 1, wherein the composition does not contain an amine compound.

* * * * *